US009244371B2

(12) United States Patent
Suzumura et al.

(10) Patent No.: US 9,244,371 B2
(45) Date of Patent: Jan. 26, 2016

(54) MAGNETIC TONER

(71) Applicant: CANON KABUSHIKI KAISHA, Tokyo (JP)

(72) Inventors: Yoshitaka Suzumura, Mishima (JP); Yusuke Hasegawa, Suntou-gun (JP); Michihisa Magome, Mishima (JP); Kozue Uratani, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/362,380

(22) PCT Filed: Dec. 26, 2012

(86) PCT No.: PCT/JP2012/084290

§ 371 (c)(1),
(2) Date: Jun. 2, 2014

(87) PCT Pub. No.: WO2013/100186

PCT Pub. Date: Jul. 4, 2013

(65) Prior Publication Data

US 2014/0322639 A1 Oct. 30, 2014

(30) Foreign Application Priority Data

Dec. 27, 2011 (JP) ..... 2011-285913

(51) Int. Cl.
*G03G 9/083* (2006.01)
*G03G 9/087* (2006.01)
*G03G 9/097* (2006.01)

(52) U.S. Cl.
CPC ..... *G03G 9/0833* (2013.01); *G03G 9/0835* (2013.01); *G03G 9/08795* (2013.01); *G03G 9/09708* (2013.01); *G03G 9/09716* (2013.01); *G03G 9/09725* (2013.01)

(58) Field of Classification Search
CPC ..... G03G 9/09725; G03G 9/09708; G03G 9/083; G03G 9/0833; G03G 9/0835
USPC ..... 430/106.1, 106.2, 108.7, 108.6, 108.4
See application file for complete search history.

(56) References Cited

U.S. PATENT DOCUMENTS 5,456,990 A * 10/1995 Takagi et al. ..... 430/106.1
5,510,222 A 4/1996 Inaba et al.
8,084,174 B2 12/2011 Hasegawa et al.
8,557,491 B2 10/2013 Sugimoto et al.

FOREIGN PATENT DOCUMENTS

JP 6-337541 A 12/1994
JP 8-328291 A 12/1996
JP 2006-154060 A 6/2006
JP 2007-293043 A 11/2007
JP 2008-15248 A 1/2008
JP 2008-102390 A 5/2008
JP 2008-281697 A 11/2008
JP 2009-276641 A 11/2009
JP 2010-32581 A 2/2010
JP 2010-39195 A 2/2010

OTHER PUBLICATIONS

European Patent Office machiine-assisted English-language translation of Japanese Patent Document JP 2008-015248 A (published Jan. 2008).*
Taiwanese Office Action dated Jan. 20, 2015 in Taiwanese Application No. 101150560.
PCT International Search Report and Written Opinion of the International Searching Authority, International Application No. JP2012/084290, Mailing Date Apr. 9, 2013.
Hiroko, et al., U.S. Appl. No. 14/364,065, filed Jun. 9, 2014.
Magome, et al., U.S. Appl. No. 14/364,068, filed Jun. 9, 2014.
Hasegawa, et al., U.S. Appl. No. 14/364,067, filed Jun. 9, 2014.
Matsui, et al., U.S. Appl. No. 14/362,377, filed Jun. 2, 2014.
Ohmori, et al., U.S. Appl. No. 14/364,633, filed Jun. 11, 2014.
Sano, et al., U.S. Appl. No. 14/364,636, filed Jun. 11, 2014.
Uratani, et al., U.S. Appl. No. 14/364,634, filed Jun. 11, 2014.
Nomura, et al., U.S. Appl. No. 14/364,640, filed Jun. 11, 2014.
Tanaka, et al., U.S. Appl. No. 14/364,638, filed Jun. 11, 2014.

* cited by examiner

*Primary Examiner* — Janis L Dote
(74) *Attorney, Agent, or Firm* — Fitzpatrick, Cella, Harper and Scinto

(57) ABSTRACT

A magnetic toner contains magnetic toner particles containing a binder resin, a release agent, and a magnetic body and inorganic fine particles present on the surface of the magnetic toner particles, wherein the inorganic fine particles present on the surface of the magnetic toner particles contain metal oxide fine particles, as described in the specification. The coverage ratio of the magnetic toner particles' surface by the inorganic fine particles and the coverage ratio by the inorganic fine particles fixed to the magnetic toner particles' surface reside in a prescribed relationship, the binder resin contains a polyester resin, the release agent contains an ester compound, and an endothermic peak for the magnetic toner has a prescribed value.

5 Claims, 7 Drawing Sheets

MAGNETIC TONER

TECHNICAL FIELD

The present invention relates to a magnetic toner for use in, for example, electrophotographic methods, electrostatic recording methods, and magnetic recording methods.

BACKGROUND ART

Copiers and printers are undergoing device downsizing and enhancements in energy efficiency, and magnetic monocomponent development systems that use a favorable magnetic toner are preferably used in this context.

In a magnetic monocomponent development system, development is carried out by transporting a magnetic toner into the development zone using a toner-carrying member (referred to below as a developing sleeve) that incorporates in its interior means of generating a magnetic field, e.g., a magnet roll. In addition, charging of the magnetic toner is carried out, mainly in the zone where the magnetic toner is subjected to control by a toner control member (also referred to herebelow as a developing blade), by tribocharging due to rubbing between the magnetic toner and a tribocharge-providing member, e.g., a developing sleeve. Reducing the size of the developing sleeve is an important technology in particular from the standpoint of reducing the size of the device.

Given these circumstances, fixation tailing is an image defect of concern for the future. This problem is caused when the toner is blown off due to the generation of a current of water vapor from the recording medium, e.g., paper, when heat is applied in the fixing section. This problem is prone to appear, for example, with images that tend to have a high toner laid-on level, e.g., horizontal line images. This problem also readily occurs in cases of a large current of water vapor produced from the recording medium. As a consequence, this problem tends to get even worse in high-temperature, high-humidity environments.

There has been much research on this image defect known as fixation tailing, with a focus on engineering the low-temperature fixability of magnetic toner and on engineering the charging performance of magnetic toner.

In Patent Document 1, the attempt is made, by improving the low-temperature fixability of the magnetic toner, to inhibit spots around line images and to improve the fixation tailing with magnetic toners.

In Patent Document 2, the attempt is made to raise the electrostatic adsorptive force to the recording medium and improve fixation tailing by improving the charging performance of the parent material of the magnetic toner.

In Patent Document 3, the attempt is made to improve the fixation tailing by controlling the charging performance of external additives and controlling the releasability by the magnetic toner from the photosensitive member.

A certain effect on the fixation tailing is in fact seen due to engineering of the low-temperature fixability of magnetic toner and engineering of the charging performance of magnetic toner. However, it is thought that there is room for additional improvement in order to satisfy the needs of recent years.

Several factors as described in the following may be offered as possible causes here.

(1) When the diameter of the developing sleeve is reduced in order to reduce the size of the printer body, it becomes difficult to secure and maintain the charging performance of the magnetic toner, which as a consequence impairs the ability to inhibit the appearance of fixation tailing. The reason for this is as follows: with a reduced-diameter developing sleeve, the zone (referred to below as the control nip) in which the toner control member in contact with the developing sleeve can control the toner laid-on level is narrowed and a tendency appears for the amount of charge on the magnetic toner to decline.

(2) Lowering the fixation temperature in pursuit of greater energy savings for a printer works against inhibiting the appearance of fixation tailing. In particular, fixation tailing readily undergoes additional increases when the recording medium is a so-called heavy paper that impedes the propagation of heat from the fixing unit to the magnetic toner.

Given this background, there was still room for investigations in order to improve the fixation tailing.

CITATION LIST

Patent Literature

[PTL 1] Japanese Patent Application Publication No. 2008-102390

[PTL 2] Japanese Patent Application Publication No. 2010-32581

[PTL 3] Japanese Patent Application Publication No. 2009-276641

[PTL 4] Japanese Patent Application Publication No. 2007-293043

SUMMARY OF INVENTION

Technical Problems

An object of the present invention is to provide a magnetic toner that can solve the problems identified above.

Specially, an object of the present invention is to provide a magnetic toner that yields a stable image density regardless of the use environment and that can prevent the occurrence of fixation tailing.

The present inventors discovered that the problems can be solved by specifying the relationship between the coverage ratio A of the magnetic toner particles' surface by the inorganic fine particles and the coverage ratio B of the magnetic toner particles' surface by inorganic fine particles that are fixed to the magnetic toner particle surface and a coefficient of variation on the coverage ratio A, and by specifying the combination of the binder resin and the release agent in the magnetic toner. The present invention was achieved based on this discovery. Thus, the present invention is described as follows:

a magnetic toner comprising: magnetic toner particles containing a binder resin, a release agent, and a magnetic body; and inorganic fine particles present on the surface of the magnetic toner particles, wherein the inorganic fine particles present on the surface of the magnetic toner particles contain metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has:

i) a coverage ratio A of at least 45.0% and not more than 70.0%, and a coefficient of variation on the coverage ratio A of not more than 10.0%, and ii) a ratio [coverage ratio B/coverage ratio A] of the coverage ratio B to the coverage ratio A of at least 0.50 and not more than 0.85;

wherein the binder resin contains a polyester resin;

the release agent contains an ester compound; and an endothermic peak is present from at least 60° C. to not more than 90° C. when the magnetic toner is measured with a differential scanning calorimeter (DSC).

Advantageous Effects of Invention

The present invention can provide a magnetic toner that, regardless of the use environment, yields a stable image density and can prevent the occurrence of fixation tailing.

DESCRIPTION OF EMBODIMENTS

Figure 1:
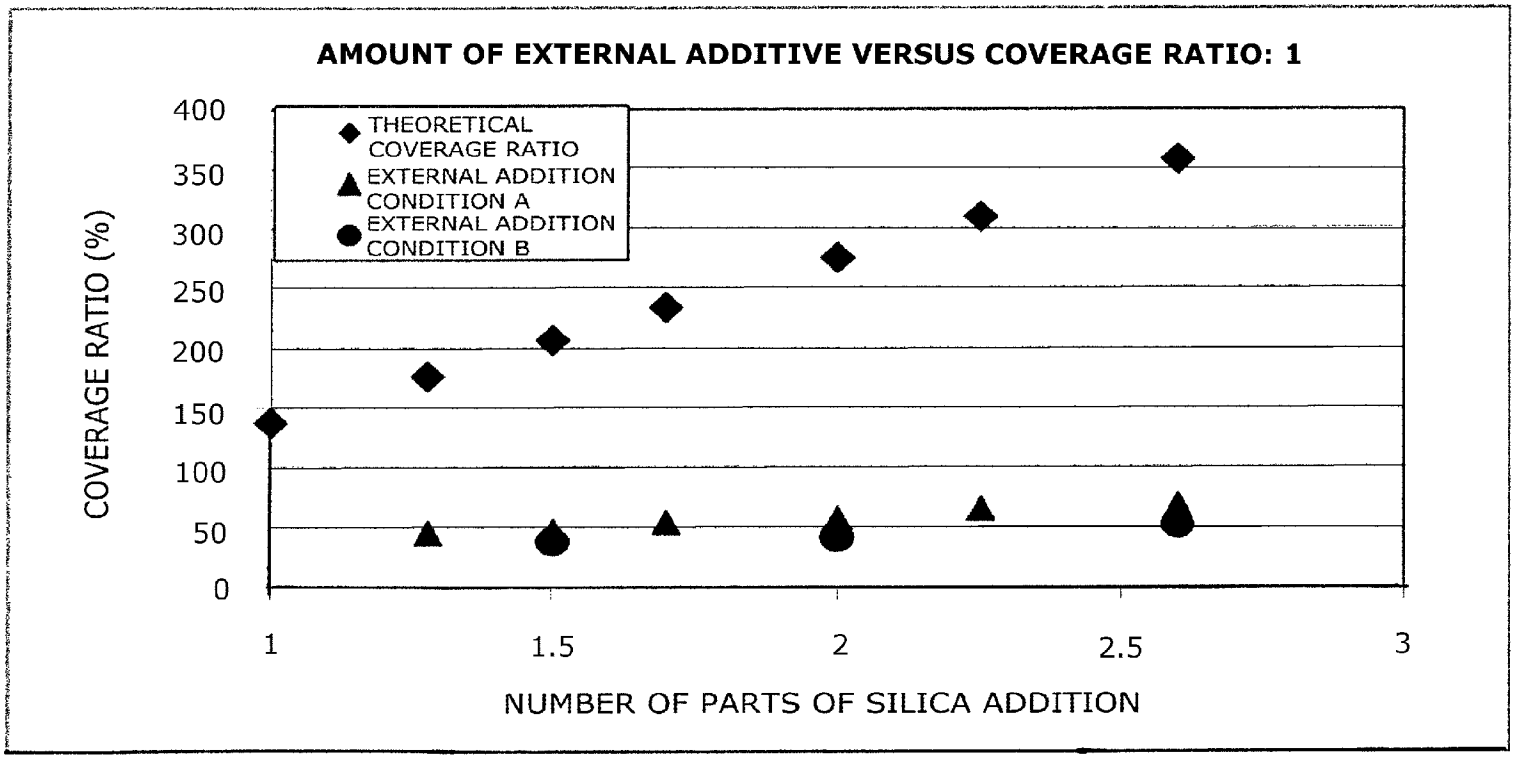
FIG. 1 is a diagram that shows an example of the relationship between the number of parts of silica addition and the coverage ratio.

The present invention is described in detail below.

The present invention relates to a magnetic toner comprising: magnetic toner particles containing a binder resin, a release agent, and a magnetic body; and inorganic fine particles present on the surface of the magnetic toner particles, wherein the inorganic fine particles present on the surface of the magnetic toner particles contain metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles; when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has a coverage ratio A of at least 45.0% and not more than 70.0%, and a coefficient of variation on the coverage ratio A of not more than 10.0%, and a ratio [coverage ratio B/coverage ratio A] of the coverage ratio B to the coverage ratio A of at least 0.50 and not more than 0.85; the binder resin contains a polyester resin; the release agent contains an ester compound; and an endothermic peak is present from at least 60° C. to not more than 90° C. when the magnetic toner is measured with a differential scanning calorimeter (DSC).

According to investigations by the present inventors, the use of the above-described magnetic toner can provide a stable image density regardless of the use environment and can suppress the generation of fixation tailing.

The appearance of "fixation tailing" here is hypothesized to be caused by the following.

When the recording medium bearing unfixed magnetic toner enters the fixing unit, the moisture present in the recording medium is evaporated by the heat from the fixing unit and a current of water vapor is thereby produced. When, at this point, the magnetic toner is blown off by the water vapor current prior to the former's melting and fixing to the recording medium, an image is formed in which magnetic toner has been scattered out at the bottom edge of the image. This phenomenon is fixation tailing.

That is, when image output is performed in a high-temperature, high-humidity environment with the recording medium having adsorbed large amounts of moisture, the production of the water vapor current becomes prominent and fixation tailing then tends to worsen. Fixation tailing also readily worsens when image output is performed using a reduced fixation temperature since the magnetic toner is blown off by the water vapor current prior to the melting of the magnetic toner. In addition, the temperature of the fixing unit temporarily drops below the set temperature when printing is carried out continuously, as a consequence of which the magnetic toner is blown off by the water vapor current prior to the melting of the magnetic toner and fixation tailing is then again prone to worsen.

Moreover, with an apparatus that uses a small-diameter developing sleeve in order to achieve size reduction, the zone (referred to below as the control nip) in which the developing blade in contact with the developing sleeve can control the toner laid-on level is narrowed. Since the magnetic toner holds its charge by rubbing with the developing sleeve in the control nip, a narrowed control nip results in a smaller amount of charge on the magnetic toner. This results in a reduction in the electrostatic adsorptive force by the magnetic toner to the recording medium and hence in a propensity for the fixation tailing to worsen.

As a result of their investigations, the present inventors discovered that it is crucial that the magnetic toner satisfy all of the following four points in order to inhibit the appearance of the fixation tailing described above.

(1) An increase in the quantity of charge on the magnetic toner.

(2) An increase in the sharp melt property of the magnetic toner.

(3) The formation on the recording medium of an unfixed image in which the magnetic toner is present at a high density.

(4) Achieving a uniform state of coverage by the inorganic fine particles in the magnetic toner.

First, by increasing the quantity of charge on the magnetic toner, the electrostatic adsorptive force exercised by the magnetic toner for the recording medium can be increased and blow off of the magnetic toner from the recording medium by the water vapor current can be impeded.

With regard to the sharp melt property of the magnetic toner, in order to inhibit fixation tailing, it is important that, as described above, the magnetic toner be fixed to the recording medium before the magnetic toner is blown off from the recording medium by the water vapor current. Due to this, the sharp melt property of the magnetic toner must be enhanced in order to achieve rapid melting and fixing to the recording medium in the fixing step.

Among the four points listed above, the technologies of (1) and (2) have been inadequate for inhibiting fixation tailing for devices that use a small-diameter developing sleeve and conditions such as a temperature setting intended to achieve low-temperature fixing. The present inventors discovered that, by the additional combination of the technologies in (3) and (4) in the present invention, fixation tailing can be improved even for conditions severer than the heretofore contemplated conditions.

Furthermore, when the magnetic toner particles are melted by forming on the recording medium an unfixed image in which the magnetic toner is present at a high density, adjacent magnetic toner particles will then also readily undergo melting and bonding to each other similarly. The bonding of a large number of particles to form a group is very important for inhibiting fixation tailing.

In addition, even when loading to a high density has been done, the state of coverage by the inorganic fine particles on the magnetic toner is a factor that can impede the melt bonding of the magnetic toner particles. For example, melt bonding between neighboring magnetic toner particles is impeded when the coverage ratio by the inorganic fine particles for some magnetic toner particles is excessively high. It is thus also very important for inhibiting fixation tailing to exercise judicious control of the state of coverage by the inorganic fine particles on the magnetic toner particle surface so as to avoid a high local coverage ratio by the inorganic fine particles.

The present inventors believed that the above-described state could be achieved for the first time by simultaneously engineering the structure of the parent magnetic toner particle and carrying out control of the state of external addition of the inorganic fine particles to the magnetic toner. The present inventors also discovered that fixation tailing could be effectively inhibited, even under conditions severer than before, by a magnetic toner that satisfies all of these four points at the same time.

Moreover, when a coverage ratio A (%) is the coverage ratio of the magnetic toner particles' surface by the inorganic fine particles and a coverage ratio B (%) is the coverage ratio of the magnetic toner particles' surface by the inorganic fine particles that are fixed to the magnetic toner particles' surface, it is critical for the magnetic toner of the present invention that the coverage ratio A be at least 45.0% and not more than 70.0% and that the ratio [coverage ratio B/coverage ratio A] of the coverage ratio B to the coverage ratio A be at least 0.50 and not more than 0.85.

Since the coverage ratio A by the inorganic fine particles in the magnetic toner of the present invention is high at at least 45.0%, the van der Waals force and electrostatic force with a member are low and it is then difficult for the magnetic toner to remain on the developing blade or developing sleeve. A reduction in the attachment force to the developing blade and developing sleeve can thus be obtained by controlling the coverage ratio into the range given above. Due to this, the charge up of a portion of the magnetic toner by repeated rubbing can be inhibited and a uniform increase in the amount of charge on the magnetic toner is facilitated. The inorganic fine particles must be added in large amounts in order to bring the coverage ratio A above 70.0%, but, even if an external addition method could be devised here, image defects (vertical streaks) brought about by released inorganic fine particles are then readily produced and this is therefore disfavored.

This coverage ratio A, coverage ratio B, and ratio [B/A] of the coverage ratio B to the coverage ratio A can be determined by the methods described below.

The coverage ratio A used in the present invention is a coverage ratio that also includes the easily-releasable inorganic fine particles, while the coverage ratio B is the coverage ratio due to inorganic fine particles that are fixed to the magnetic toner particle surface and are not released in the release process described below. It is thought that the inorganic fine particles represented by the coverage ratio B are fixed in a semi-embedded state in the magnetic toner particle surface and therefore do not undergo displacement even when the magnetic toner is subjected to shear on the developing sleeve or on the electrostatic latent image-bearing member.

The inorganic fine particles represented by the coverage ratio A, on the other hand, include the fixed inorganic fine particles described above as well as inorganic fine particles that are present in the upper layer and have a relatively high degree of freedom.

As noted above, it is thought that the inorganic fine particles that can be present between magnetic toner particles and between the magnetic toner and the various members participate in bringing about the effect of diminished van der Waals forces and diminished electrostatic forces and that having a high coverage ratio A is particularly critical with regard to this effect.

That B/A is from at least 0.50 to not more than 0.85 means that inorganic fine particles fixed to the magnetic toner particle surface are present to a certain degree and that in addition inorganic fine particles in a readily releasable state (a state that enables behavior separated from the magnetic toner particle) are also present thereon in a favorable amount. It is thought that a bearing-like effect is generated presumably by the releasable inorganic fine particles sliding against the fixed inorganic fine particles and that the aggregative forces between the magnetic toners are then substantially reduced.

The coverage ratio A is preferably from at least 45% to not more than 65% and B/A is preferably from at least 0.55 to not more than 0.80.

According to the results of investigations by the present inventors, it was found that this bearing effect and the above-described attachment force-reducing effect are maximally obtained when both the fixed inorganic fine particles and the easily releasable inorganic fine particles are relatively small inorganic fine particles having a primary particle number-average particle diameter (D1) of approximately not more than 50 nm. Accordingly, the coverage ratio A and the coverage ratio B were calculated focusing on the inorganic fine particles having a primary particle number-average particle diameter (D1) of not more than 50 nm.

By setting prescribed ranges for the coverage ratio A and B/A for the magnetic toner of the present invention, the attachment force between the magnetic toner and various members can be reduced and the aggregative forces between the magnetic toners can be substantially diminished. As a result, an increased opportunity for contact between each individual magnetic toner particle and the developing blade and developing sleeve can be provided in the region of contact with the developing blade and developing sleeve, and due to this a very efficient charging is made possible for the first time. As a consequence, the quantity of charge on the magnetic toner can be raised even for a reduced-diameter developing sleeve, where increasing the amount of charge on the magnetic toner is particularly difficult.

When the coverage ratio A is less than 45.0%, a portion of the magnetic toner ends up being charged up while the amount of charge on the remaining magnetic toner declines.

At the same time, by substantially lowering the aggregative forces between the magnetic toners as described above, the magnetic toner can be loaded at a high density in the unfixed image on the recording medium. While the reason for this is not entirely clear, the following reason is hypothesized.

As described above, in a magnetic monocomponent development system, development is carried out by transporting the magnetic toner into the development zone using a developing sleeve that incorporates in its interior means of generating a magnetic field, e.g., a magnet roll. In addition, charge is imparted to the magnetic toner by tribocharging brought about by rubbing between the magnetic toner and a tribocharge-providing member, for example, the developing sleeve, in the zone in which the magnetic toner is controlled by the developing blade. In the developing zone, the magnetic toner on the developing sleeve forms magnetic spikes along the magnetic lines of force of the magnetic field.

Investigations by the present inventors demonstrated that a magnetic toner having low aggregative forces between the magnetic toners forms magnetic spikes that are very densely packed, such that the magnetic toner particles approximate closest packing. The reason for the very dense packing is hypothesized to be as follows: a magnetic toner that exhibits low aggregative forces has a high degree of freedom in its movement and as a result readily achieves closest packing when the magnetic toner is drawn to the surface of the developing sleeve by the magnetic field, for example, a magnet roll. In addition, the present inventors believe that a very dense loading of magnetic toner in the unfixed image on the recording medium is made possible by the development of the very densely packed magnetic spikes and their transfer to the recording medium.

The present inventors have analyzed the influence exercised by the coverage ratio A on the aggregative forces between the toners and the van der Waals force based on the following model.

The van der Waals force (F) produced between a flat plate and a particle is represented by the following equation.

$$F=H\times D/(12Z^2)$$

Here, H is Hamaker's constant, D is the diameter of the particle, and Z is the distance between the particle and the flat plate. With respect to Z, it is generally held that an attractive force operates at large distances and a repulsive force operates at very small distances, and Z is treated as a constant since it is unrelated to the state of the magnetic toner particle surface. According to the preceding equation, the van der Waals force (F) is proportional to the diameter of the particle in contact with the flat plate. When this is applied to the magnetic toner surface, the van der Waals force (F) is assumed to be smaller for an inorganic fine particle, with its smaller particle size, in contact with the flat plate than for a magnetic toner particle in contact with the flat plate. That is, the van der Waals force is smaller for the case of contact through the intermediary of the fine inorganic particles provided as an external additive than for the case of direct contact between the magnetic toner particle and the flat plate.

Furthermore, the electrostatic force can be regarded as a reflection force. It is known that a reflection force is directly proportional to the square of the particle charge (q) and is inversely proportional to the square of the distance.

In the case of the charging of a magnetic toner, it is the surface of the magnetic toner particle and not the inorganic fine particles that bear the charge. Due to this, the reflection force declines as the distance between the surface of the magnetic toner particle and the flat plate grows larger. That is, when, in the case of the magnetic toner surface, the magnetic toner particle comes into contact with the flat plate through the intermediary of the inorganic fine particles, a distance is set up between the flat plate and the surface of the magnetic toner particle and the reflection force is assumed to be lowered as a result.

Whether the magnetic toner particle contacts the flat plate or is in contact therewith through the intermediary of the inorganic fine particles, depends on the amount of inorganic fine particles coating the magnetic toner particle surface, i.e., on the coverage ratio by the inorganic fine particles. Therefore, it is necessary to take into account the rate of inorganic particle coverage to the magnetic toner particle surface.

It is thought that the opportunity for direct contact between the magnetic toner particles and the flat plate is diminished at a high coverage ratio by the inorganic fine particles, which makes it more difficult for the magnetic toner to stick to the flat plate. On the other hand, the magnetic toner readily sticks to the flat plate at a low coverage ratio by the inorganic fine particles.

The coverage ratio by the inorganic fine particles as an external additive can be calculated—making the assumption that the inorganic fine particles and the magnetic toner have a spherical shape—using the equation described, for example, in Patent Literature 4. However, there are also many instances in which the inorganic fine particles and/or the magnetic toner do not have a spherical shape, and in addition the inorganic fine particles may also be present in an aggregated state on the toner particle surface. As a consequence, the coverage ratio derived using the indicated technique does not pertain to the present invention.

The present inventors therefore carried out observation of the magnetic toner surface with the scanning electron microscope (SEM) and determined the coverage ratio for the actual coverage of the magnetic toner particle surface by the inorganic fine particles.

Figure 2:
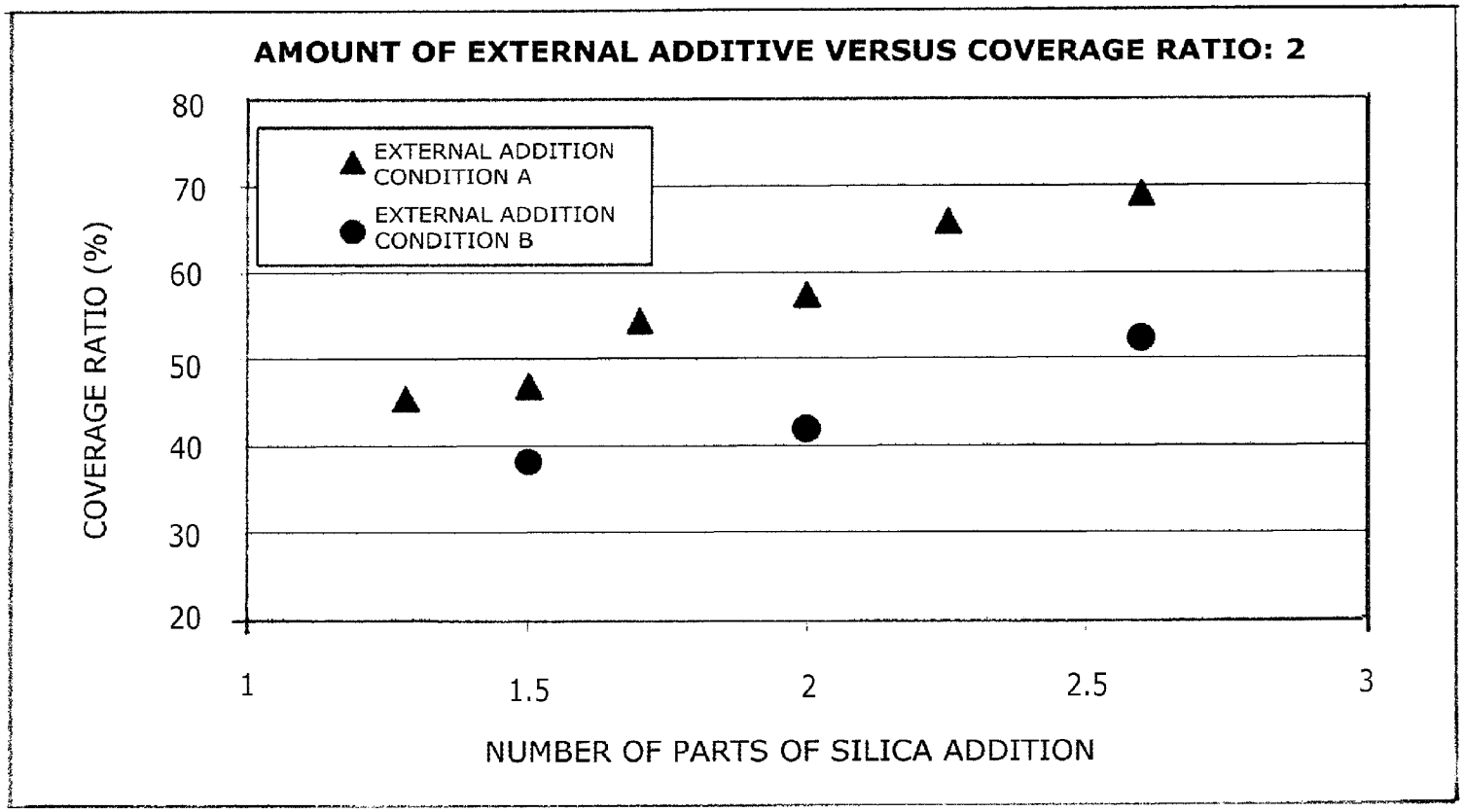
FIG. 2 is a diagram that shows an example of the relationship between the number of parts of silica addition and the coverage ratio.

As one example, the theoretical coverage ratio and the actual coverage ratio were determined for mixtures prepared by adding different amounts of silica fine particles (number of parts of silica addition to 100 mass parts of magnetic toner particles) to magnetic toner particles (magnetic body content=43.5 mass %) provided by a pulverization method and having a volume-average particle diameter (Dv) of 8.0 μm (refer to FIGS. 1 and 2). Silica fine particles with a volume-average particle diameter (Dv) of 15 nm were used for the silica fine particles. For the calculation of the theoretical coverage ratio, 2.2 g/cm$^3$ was used for the true specific gravity of the silica fine particles; 1.65 g/cm$^3$ was used for the true specific gravity of the magnetic toner; and monodisperse particles with a particle diameter of 15 nm and 8.0 μm were assumed for, respectively, the silica fine particles and the magnetic toner particles.

As is clear from the graph in FIG. 1, the theoretical coverage ratio exceeds 100% as the number of parts of silica addition is increased. On the other hand, the coverage ratio, which is obtained through the actual observation, does vary with the number of parts of silica addition, but does not exceed 100%. This is due to silica fine particles being present to some degree as aggregates on the magnetic toner surface or is due to a large effect from the silica fine particles not being spherical.

Moreover, according to investigations by the present inventors, it was found that, even at the same amount of addition by the silica fine particles, the coverage ratio varied with the external addition technique. That is, it is not possible to determine the coverage ratio uniquely from the amount of addition of the inorganic fine particles (refer to FIG. 2). Here, external addition condition A refers to mixing at 1.0 W/g for a processing time of 5 minutes using the apparatus shown in FIG. 4. External addition condition B refers to mixing at 4000 rpm for a processing time of 2 minutes using an FM10C HENSCHEL™ MIXER (from Mitsui Miike Chemical Engineering Machinery Co., Ltd.).

For the reasons provided in the preceding, the present inventors used the inorganic fine particle coverage ratio obtained by SEM observation of the magnetic toner surface.

In addition, as has been noted above, it is thought that the attachment force to a member can be reduced by raising the coverage ratio by the inorganic fine particles. Tests were therefore carried out on the attachment force with a member and the coverage ratio by the inorganic fine particles.

The relationship between the coverage ratio for the magnetic toner and the attachment force with a member was indirectly inferred by measuring the static friction coefficient between an aluminum substrate and spherical polystyrene particles having different coverage ratios by silica fine particles.

Specifically, the relationship between the coverage ratio and the static friction coefficient was determined using spherical polystyrene particles (weight-average particle diameter (D4)=6.5 μm) that had different coverage ratios (determined by SEM observation) by silica fine particles.

Figure 3:
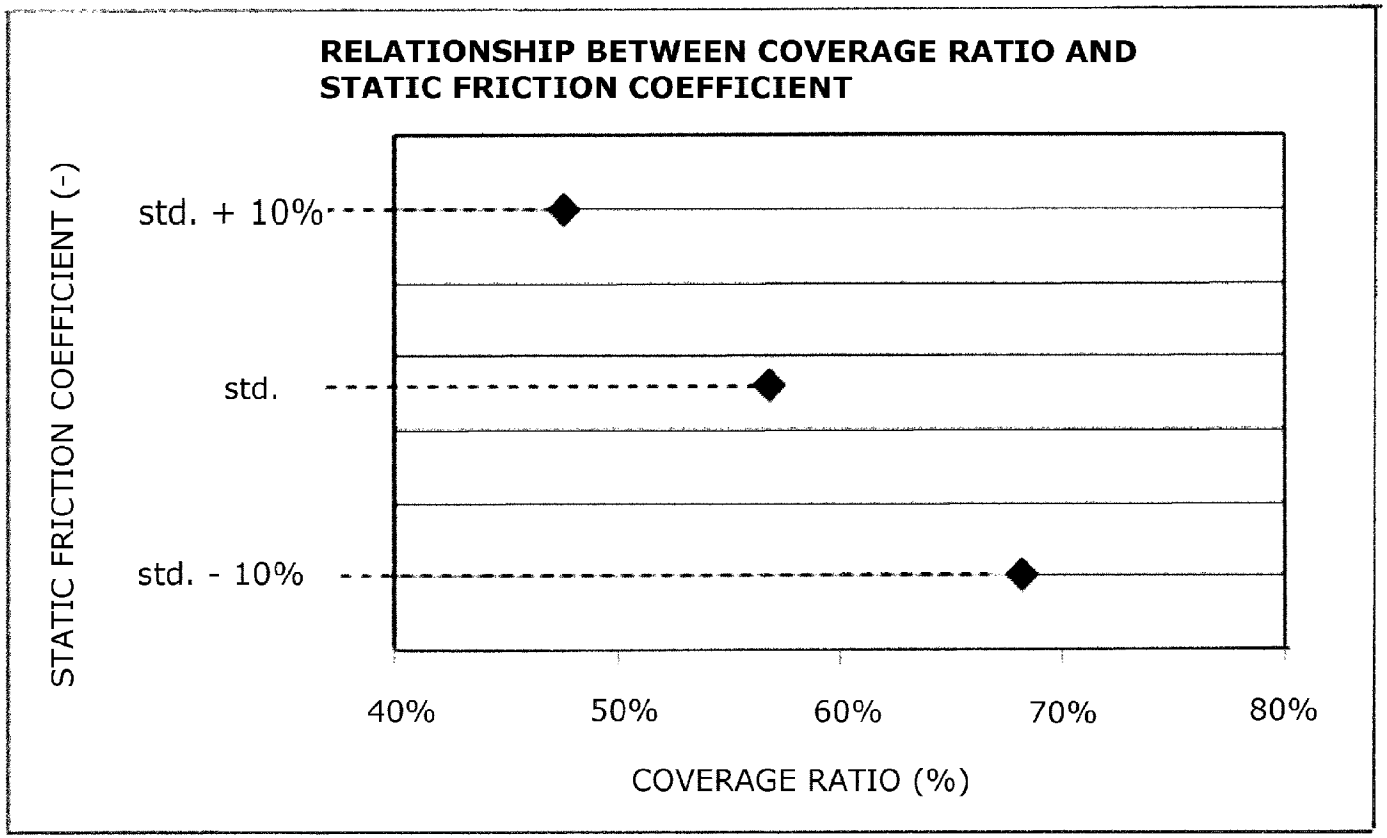
FIG. 3 is a diagram that shows an example of the relationship between the coverage ratio and the static friction coefficient.

More specifically, spherical polystyrene particles to which silica fine particles had been added were pressed onto an aluminum substrate. The substrate was moved to the left and right while changing the pressing pressure, and the static friction coefficient was calculated from the resulting stress. This was performed for the spherical polystyrene particles at each different coverage ratio, and the obtained relationship between the coverage ratio and the static friction coefficient is shown in FIG. 3.

The static fraction coefficient determined by the preceding technique is thought to correlate with the sum of the van der Waals and reflection forces acting between the spherical polystyrene particles and the substrate. According to FIG. 3, a trend appears in which the static friction coefficient declines as the coverage ratio by the silica fine particles increases. That is, it is inferred that a magnetic toner having a high coverage rate by inorganic fine particles also has a low attachment force for a member.

Based on the model described to this point, the present inventors believe that the coverage ratio A exercises a strong influence on the aggregative forces between the magnetic toners and on the van der Waals force.

It is crucial for the magnetic toner of the present invention that the binder resin contains a polyester ester, that the release agent contains an ester compound, and that an endothermic peak be present ranging from at least 60° C. to not more than 90° C. when the magnetic toner is measured with a differential scanning calorimeter (DSC).

When the binder resin contains a polyester resin and the release agent contains an ester compound, a microfine dispersion of the release agent in the binder resin can easily be brought about due to the high affinity between these materials. As a consequence, when the magnetic toner receives heat from the fixing unit, melting of the magnetic toner as a whole is facilitated because the release agent begins to melt at the melting point and is microfinely dispersed in the binder resin. Furthermore, by having the endothermic peak at a certain temperature when the magnetic toner is measured with a differential scanning calorimeter (DSC), melting of the magnetic toner will then begin at that temperature. It is crucial for inhibiting fixation tailing that this temperature be lower than the temperature at which a water vapor current is generated. When the endothermic peak is less than 60° C., the storability of the magnetic toner is degraded and this is therefore disfavored. When the endothermic peak is at not more than 90° C., this facilitates improvement in the fixation tailing and is therefore preferred. When the binder resin does not contain a polyester resin, melting of the magnetic toner can be facilitated—in order to improve the fixation tailing—by lowering the glass-transition temperature (Tg) and/or the molecular weight of the binder resin; however, this also results in a substantial deterioration in the storability. Similarly, when an ester compound is not used for the release agent, melting of the magnetic toner can be facilitated by using a release agent that has a low melting point or by increasing the number of parts of addition of the release agent; however, the storability is again degraded. By inducing a microfine dispersion of the release agent in the binder resin through the combination of a component of the binder resin and the type of release agent, the storability can be maintained unchanged while melting of the magnetic toner is facilitated (i.e., a sharp melt property is obtained). Improvement in the fixation tailing is made possible as a result. This endothermic peak temperature is preferably from at least 65° C. to not more than 85° C.

As described in the preceding, it is critical for the magnetic toner of the present invention that the coverage ratio A be from at least 45.0% to not more than 70.0% and that the coefficient of variation on the coverage ratio A be not more than 10.0%. Moreover, the coefficient of variation on the coverage ratio A is preferably not more than 8.0%.

By making the coverage ratio A be at least 45.0%, the attachment force-reducing effect and bearing effect are raised, the high density loading of the unfixed image is facilitated, and the charging performance of the magnetic toner can be raised even for small-diameter developing sleeves. On the other hand, interference with magnetic toner-to-magnetic toner melt bonding is restrained by having the coverage ratio A be not more than 70.0%. The coefficient of variation on the coverage ratio A indicates the uniformity of this coverage ratio within a magnetic toner particle and between particles. Thus, the specification of a small coefficient of variation on the coverage ratio A indicates that the coverage ratio by the inorganic fine particles is uniform and that regions with a high local coverage ratio are minor. When the coefficient of variation on the coverage ratio A is not more than 10.0%, regions with a high local coverage ratio—which interfere with magnetic toner-to-magnetic toner melt bonding—are minor, and this is crucial for inhibiting fixation tailing. When the coefficient of variation exceeds 10.0%, an improvement in fixation tailing cannot be obtained even when the unfixed image has a high density.

There are no particular limitations on the technique for bringing the coefficient of variation on the coverage ratio A to 10.0% or below, but the use is preferred of the external addition apparatus and technique described below, which are capable of bringing about a high degree of spreading of the metal oxide fine particles, e.g., silica fine particles, over the magnetic toner particles' surface.

The binder resin for the toner of the present invention comprises a polyester resin. However, to the degree that the effects of the present invention are not impaired, the binder resin may also contain resins known for use as the binder resin in toners.

The composition of this polyester resin is as described in the following.

The divalent alcohol component constituting the polyester resin can be exemplified by ethylene glycol, propylene glycol, butanediol, diethylene glycol, triethylene glycol, pentanediol, hexanediol, neopentyl glycol, hydrogenated bisphenol A, bisphenols with the following formula (A) and their derivatives, and diols with the following formula (B).

[Chem 1]

(A)

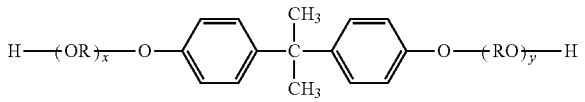

(In the formula, R is an ethylene group or propylene group; x and y are each integers greater than or equal to 0; and the average value of x+y is greater than or equal to 0 and less than or equal to 10.)

[Chem 2]

(B)

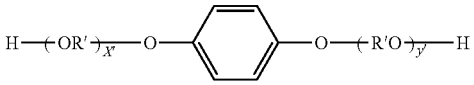

(In the formula, R' is —$CH_2CH_2$— or —$CH_2CH(CH_3)$— or —$CH_2$—$C(CH_3)_2$—; x' and y' are integers greater than or equal to 0; and the average value of x'+y' is greater than or equal to 0 and less than or equal to 10.)

The divalent acid component constituting this polyester resin can be exemplified by benzenedicarboxylic acids such as phthalic acid, terephthalic acid, isophthalic acid, and phthalic anhydride; alkyldicarboxylic acids such as succinic acid, adipic acid, sebacic acid, and azelaic acid; alkenylsuccinic acids such as n-dodecenylsuccinic acid; and unsaturated dicarboxylic acids such as fumaric acid, maleic acid, citraconic acid, and itaconic acid.

A trivalent or higher valent alcohol component by itself or a trivalent or higher valent acid component by itself may be used as a crosslinking component, or both may be used in combination.

The trivalent or higher valent polyvalent alcohol component can be exemplified by sorbitol, pentaerythritol, dipentaerythritol, tripentaerythritol, butanetriol, pentanetriol, glycerol, methylpropanetriol, trimethylolethane, trimethylolpropane, and trihydroxybenzene.

The trivalent or higher valent polyvalent carboxylic acid component in the present invention can be exemplified by trimellitic acid, pyromellitic acid, benzenetricarboxylic acid, butanetricarboxylic acid, hexanetricarboxylic acid, and tetracarboxylic acids with the following formula (C).

[Chem 3]

(C)

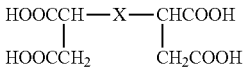

(X in the formula represents a $C_{5-30}$ alkylene group or alkenylene group that has at least one side chain that contains at least three carbons.)

The glass-transition temperature (Tg) of the magnetic toner of the present invention is preferably from at least 40° C. to not more than 70° C. When the glass-transition temperature is from at least 40° C. to not more than 70° C., the storage stability and durability can be enhanced while maintaining a favorable fixing performance. When the Tg higher than 70° C., the sharp melt property tends to be lowered.

The acid value, as measured by dissolving the magnetic toner of the present invention in a mixed solvent of toluene and ethanol and performing the measurement on the resulting soluble matter using a potentiometric titration apparatus, is preferably from at least 5 mg KOH/g to not more than 50 mg KOH/g and more preferably is from at least 10 mg KOH/g to not more than 40 mg KOH/g. Controlling the acid value into the indicated range facilitates adjustment of the magnetic toner dielectric characteristics to a desired range. In order to control this acid value into the indicated range, the acid value of the binder resin used in the present invention is preferably from at least 5 mg KOH/g to not more than 50 mg KOH/g. The details of the method for measuring the acid value are given below.

Furthermore, viewed from the standpoint of the balance between the pulverizability and the fixing performance, the polyester resin present in the binder resin of the magnetic toner of the present invention preferably has a peak molecular weight (Mp) of from 3000 to 10000 and more preferably from 5000 to 8000.

The ester compound used as the release agent in the present invention is preferably monofunctional or an at least difunctional polyfunctional ester. Among these, a monofunctional ester compound, because this ester compound readily provides a straight-chain form, has a high compatibility with the binder resin and readily provides greater improvement in the fixation tailing.

Preferred monofunctional ester compounds can be specifically exemplified by waxes in which the main component is an fatty acid ester, such as carnauba wax and montanic acid ester waxes; the product of the partial or complete deacidification of the acid component from a fatty acid ester, such as deacidified carnauba wax; hydroxyl group-containing methyl ester compounds yielded by the hydrogenation of plant fats and oils; and saturated fatty acid monoesters such as stearyl stearate and behenyl behenate.

This ester compound preferably comprises an ester compound of a fatty acid having ranging from at least 16 to not more than 22 carbon atoms or an aliphatic alcohol having ranging from at least 16 to not more than 22 carbon atoms. The ester compound is more preferably an ester compound that contains a fatty acid as a constituent component, and the number of carbons in the fatty acid as a constituent component of this ester compound is particularly preferably from at least 16 to not more than 22. The affinity with the polyester resin serving as the binder resin varies with the number of carbons in the fatty acid. Additional improvements in the developing performance and fixation tailing of the magnetic toner of the present invention can be obtained by controlling this number of carbons into the indicated range.

In addition to the fatty acids constituting the above-described monofunctional ester compound, myristic acid, palmitic acid, arachidic acid, lignoceric acid, and so forth are preferred for the fatty acid constituent component of the ester compound. In addition to the alcohols constituting the above-described monofunctional ester compound, arachidic acid alcohol and dipentaerythritol are preferred for the alcohol constituent component of the ester compound.

The magnetic toner of the present invention has an endothermic peak at from at least 60° C. to not more than 90° C. when measured with a differential scanning calorimeter (DSC). For example, an ester compound having a desired melting point can be used to control this endothermic peak into the indicated range. Or, the indicated range can also be obtained by adjusting the polymerization conditions and monomer composition used for the binder resin. The methods for measuring the endothermic peak of the magnetic toner of the present invention and the melting point of the ester compound are described below.

In addition, the amount of heat absorbed by the aforementioned endothermic peak (below: endothermic peak amount of heat) is preferably from at least 0.20 J/g to not more than 3.00 J/g. When the endothermic peak amount of heat is at least 0.20 J/g, melting of the magnetic toner as a whole is facilitated and improvement in the fixation tailing is facilitated. In addition, the endothermic peak amount of heat is not more than 3.00 J/g is preferred because this can provide an excellent inhibition of reductions in the developing performance and storability of the magnetic toner.

In order to control the endothermic peak amount of heat into the aforementioned range, the content of the ester compound in the present invention, expressed per 100 mass parts of the binder resin, is preferably from at least 1.0 mass part to not more than 10.0 mass parts. The method for measuring the endothermic peak amount of heat is described below.

For a magnetic field of 79.6 kA/m (1000 oersted), the magnetic toner in the present invention preferably has an intensity of magnetization (σs) of from at least 15 $Am^2/kg$ to not more than 45 $Am^2/kg$ and a ratio [σr/σs] of the residual magnetization (σr) to the intensity of magnetization (σs) of from at least 0.03 to not more than 0.11.

The intensity of magnetization (σs) indicates the intensity of magnetization maintained by the magnetic toner when an external magnetic field is present and corresponds to the intensity of magnetization maintained by the magnetic toner on the developing sleeve. The residual magnetization (σr) indicates the intensity of magnetization maintained by the magnetic toner when the external magnetic field is extremely small and corresponds to the intensity of magnetization maintained by the magnetic toner that has undergone development to the electrostatic latent image-bearing member (referred to below as the post-development magnetic toner).

When the intensity of magnetization (σs) under the aforementioned conditions is at least 15 $Am^2/kg$, inhibition of development (mainly fogging) in nonimage areas is facilitated by the magnetic constraining force on the magnetic toner on the developing sleeve due to the magnet roller in the developing sleeve. When, on the other hand, the intensity of magnetization (σs) is not more than 45 $Am^2/kg$, this makes it difficult for the magnetic constraining force to interfere with the development of the toner.

The intensity of magnetization (σs) is more preferably from at least 18 $\mu m^2/kg$ to not more than 35 $\mu m^2/kg$.

When the ratio [σr/σs] of the residual magnetization (σr) to the intensity of magnetization (σs) satisfies the range indicated above, due to the effect of magnetic cohesion of the magnetic toner, blow off of the magnetic toner by the water vapor current is inhibited—even on a recording medium where there is little external magnetic field—and as a consequence the fixation tailing can be improved still further. When σr/σs is less than 0.03, there is little magnetic cohesion force and as a consequence the improvement in the fixation tailing is restrained. When σr/σs is greater than 0.11, the magnetic cohesion force then becomes too strong and more magnetic toner than necessary undergoes development in the development step. In this case, more heat becomes necessary in the fixing step in order to inhibit fixation tailing. σr/σs is more preferably from at least 0.03 to not more than 0.08.

The magnetic characteristics of the magnetic toner of the present invention can be controlled through the use of magnetic bodies with different magnetic characteristics. This is also possible through judicious adjustment of the amount of the magnetic body in the magnetic toner.

The magnetic characteristics of the magnetic body can be controlled by controlling σr/σs through the incorporation of elements such as phosphorus and silicon in the magnetic body and by changing the shape of the magnetic body (spherical, polyhedral, hexahedral, octahedral) and changing the particle diameter of the magnetic body.

The magnetic body present in the magnetic toner in the present invention can be exemplified by iron oxides such as magnetite, maghemite, ferrite, and so forth; metals such as iron, cobalt, and nickel; and alloys and mixtures of these metals with metals such as aluminum, cobalt, copper, lead, magnesium, tin, zinc, antimony, beryllium, bismuth, cadmium, calcium, manganese, selenium, titanium, tungsten, and vanadium.

This magnetic body preferably has a primary particle number-average particle diameter of not more than 2 μm and more preferably of from at least 0.05 μm to not more than 0.50 μm. For the magnetic characteristics for the application of 79.6 kA/m, the intensity of magnetization is preferably from at least 30 $Am^2/kg$ to not more than 90 $Am^2/kg$ and more preferably from at least 40 $Am^2/kg$ to not more than 80 $Am^2/kg$, while the residual magnetization is preferably from at least 1.0 $Am^2/kg$ to not more than 10.0 $Am^2/kg$ and more preferably from at least 1.5 $Am^2/kg$ to not more than 8.0 $Am^2/kg$. The methods for measuring the magnetic characteristics of the magnetic toner and the magnetic body are described below.

The content for the magnetic toner of the present invention is preferably from at least 25 mass % to not more than 65 mass %. A more preferred range is from at least 30 mass % to not more than 60 mass %. Control to toner magnetic characteristics preferred for the present invention is facilitated by bringing the magnetic body content into the aforementioned mentioned.

The content of the magnetic body in the magnetic toner can be measured using a Q5000IR TGA thermal analyzer from PerkinElmer Inc. With regard to the measurement method, the magnetic toner is heated from normal temperature to 900° C. under a nitrogen atmosphere at a rate of temperature rise of 25° C./minute: the mass loss from 100 to 750° C. is taken to be the component provided by subtracting the magnetic body from the magnetic toner and the residual mass is taken to be the amount of the magnetic body.

A charge control agent is preferably added to the magnetic toner of the present invention. Since the binder resin itself has a high negative charging performance in the present invention, a negative charging toner is preferred.

Organometal complex compounds and chelate compounds are effective as charging agents for negative charging and can be exemplified by monoazo-metal complex compounds; acetylacetone-metal complex compounds; and metal complex compounds of aromatic hydroxycarboxylic acids and aromatic dicarboxylic acids. Specific examples of commercially available products are Spilon Black TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.).

A single one of these charge control agents may be used or two or more may be used in combination. Considered from the standpoint of the amount of charging of the magnetic toner, these charge control agents are used, expressed per 100 mass parts of the binder resin, preferably at from 0.1 to 10.0 mass parts and more preferably at from 0.1 to 5.0 mass parts.

The magnetic toner of the present invention contains inorganic fine particles at the magnetic toner particles' surface.

The inorganic fine particles present on the magnetic toner particles' surface can be exemplified by silica fine particles, titania fine particles, and alumina fine particles, and these inorganic fine particles can also be favorably used after the execution of a hydrophobic treatment on the surface thereof.

It is critical that the inorganic fine particles present on the surface of the magnetic toner particles in the present invention contain at least one of metal oxide fine particle selected from the group consisting of silica fine particles, titania fine particles, and alumina fine particles, and that at least 85 mass % of the metal oxide fine particles be silica fine particles. Preferably at least 90 mass % of the metal oxide fine particles are silica fine particles. The reasons for this are that silica fine particles not only provide the best balance with regard to imparting charging performance and flowability, but are also excellent from the standpoint of lowering the aggregative forces between the toners.

The reason why silica fine particles are excellent from the standpoint of lowering the aggregative forces between the toners are not entirely clear, but it is hypothesized that this is probably due to the substantial operation of the previously described bearing effect with regard to the sliding behavior between the silica fine particles.

In addition, silica fine particles are preferably the main component of the inorganic fine particles fixed to the magnetic toner particle surface. Specifically, the inorganic fine particles fixed to the magnetic toner particle surface preferably contain at least one of metal oxide fine particle selected from the group consisting of silica fine particles, titania fine particles, and alumina fine particles wherein silica fine particles are at least 80 mass % of these metal oxide fine particles. The silica fine particles are more preferably at least 90 mass %. This is hypothesized to be for the same reasons as discussed above: silica fine particles are the best from the standpoint of imparting charging performance and flowability, and as a consequence a rapid initial rise in magnetic toner charge occurs. The result is that a high image density can be obtained, which is strongly preferred.

Here, the timing and amount of addition of the inorganic fine particles may be adjusted in order to bring the silica fine particles to at least 85 mass % of the metal oxide fine particles present on the magnetic toner particle surface and to at least 80 mass % with reference to the metal oxide particles fixed on the magnetic toner particle surface.

The amount of inorganic fine particles present can be checked using the methods described below for quantitating the inorganic fine particles.

The number-average particle diameter (D1) of the primary particles in the inorganic fine particles in the present invention is preferably from at least 5 nm to not more than 50 nm and more preferably is from at least 10 nm to not more than 35 nm.

Bringing the number-average particle diameter (D1) of the primary particles in the inorganic fine particles into the indicated range facilitates favorable control of the coverage ratio A and B/A. When the primary particle number-average particle diameter (D1) is less than 5 nm, the inorganic fine particles are prone to aggregate with one another and not only is it then difficult to obtain large values for B/A, but the coefficient of variation on the coverage ratio A also readily assumes large values. When, on the other hand, the primary particle number-average particle diameter (D1) is larger than 50 nm, the coverage ratio A is then prone to be low even for large amounts of addition of the inorganic fine particles, while the value of B/A also tends to be low because the inorganic fine particles are difficult to fix to the magnetic toner particles. That is, it is difficult to obtain the above-described attachment force-reducing effect and bearing effect when the primary particle number-average particle diameter (D1) is larger than 50 nm.

A hydrophobic treatment is preferably carried out on the inorganic fine particles used in the present invention, and particularly preferred inorganic fine particles will have been hydrophobically treated to a hydrophobicity, as measured by the methanol titration test, of at least 40% and more preferably at least 50%.

The method for carrying out the hydrophobic treatment can be exemplified by methods in which treatment is carried out with, e.g., an organosilicon compound, a silicone oil, a long-chain fatty acid, and so forth.

The organosilicon compound can be exemplified by hexamethyldisilazane, trimethylsilane, trimethylethoxysilane, isobutyltrimethoxysilane, trimethylchlorosilane, dimethyldichlorosilane, methyltrichlorosilane, dimethylethoxysilane, dimethyldimethoxysilane, diphenyldiethoxysilane, and hexamethyldisiloxane. A single one of these can be used or a mixture of two or more can be used.

The silicone oil can be exemplified by dimethylsilicone oil, methylphenylsilicone oil, α-methylstyrene-modified silicone oil, chlorophenyl silicone oil, and fluorine-modified silicone oil.

A $C_{10-22}$ fatty acid is suitably used for the long-chain fatty acid, and the long-chain fatty acid may be a straight-chain fatty acid or a branched fatty acid. A saturated fatty acid or an unsaturated fatty acid may be used.

Among the preceding, $C_{10-22}$ straight-chain saturated fatty acids are highly preferred because they readily provide a uniform treatment of the surface of the inorganic fine particles.

These straight-chain saturated fatty acids can be exemplified by capric acid, lauric acid, myristic acid, palmitic acid, stearic acid, arachidic acid, and behenic acid.

Inorganic fine particles that have been treated with silicone oil are preferred for the inorganic fine particles used in the present invention, and inorganic fine particles treated with an organosilicon compound and a silicone oil are more preferred. This makes possible a favorable control of the hydrophobicity.

The method for treating the inorganic fine particles with a silicone oil can be exemplified by a method in which the silicone oil is directly mixed, using a mixer such as a HENSCHEL™ MIXER, with inorganic fine particles that have been treated with an organosilicon compound, and by a method in which the silicone oil is sprayed on the inorganic fine particles. Another example is a method in which the silicone oil is dissolved or dispersed in a suitable solvent; the inorganic fine particles are then added and mixed; and the solvent is removed.

In order to obtain a good hydrophobicity, the amount of silicone oil used for the treatment, expressed per 100 mass parts of the inorganic fine particles, is preferably from at least 1 mass part to not more than 40 mass parts and is more preferably from at least 3 mass parts to not more than 35 mass parts.

In order to impart an excellent flowability to the magnetic toner, the silica fine particles, titania fine particles, and alumina fine particles used by the present invention have a specific surface area as measured by the BET method based on nitrogen adsorption (BET specific surface area) preferably of from at least 20 $m^2/g$ to not more than 350 $m^2/g$ and more preferably of from at least 25 $m^2/g$ to not more than 300 $m^2/g$.

Measurement of the specific surface area (BET specific surface area) by the BET method based on nitrogen adsorption is performed based on JIS 28830 (2001). A "TriStar300

(Shimadzu Corporation) automatic specific surface area•pore distribution analyzer", which uses gas adsorption by a constant volume technique as its measurement procedure, is used as the measurement instrument.

The amount of addition of the inorganic fine particles, expressed per 100 mass parts of the magnetic toner particles, is preferably from at least 1.5 mass parts to not more than 3.0 mass parts of the inorganic fine particles, more preferably from at least 1.5 mass parts to not more than 2.6 mass parts, and even more preferably from at least 1.8 mass parts to not more than 2.6 mass parts.

Setting the amount of addition of the inorganic fine particles in the indicated range is also preferred from the standpoint of facilitating appropriate control of the coverage ratio A and B/A.

Exceeding 3.0 mass parts for the amount of addition of the inorganic fine particles, even if an external addition apparatus and an external addition method could be devised, gives rise to release of the inorganic fine particles and facilitates the appearance of, for example, a streak on the image.

In addition to the above-described inorganic fine particles, particles with a primary particle number-average particle diameter (D1) of from at least 80 nm to not more than 3 μm may be added to the magnetic toner of the present invention. For example, a lubricant, e.g., a fluororesin powder, zinc stearate powder, or polyvinylidene fluoride powder; a polish, e.g., a cerium oxide powder, a silicon carbide powder, or a strontium titanate powder; or a spacer particle such as silica, may also be added in small amounts that do not influence the effects of the present invention.

Viewed from the standpoint of the balance between the developing performance and the fixing performance, the weight-average particle diameter (D4) of the magnetic toner of the present invention is preferably from at least 6.0 μm to not more than 10.0 μm and more preferably is from at least 7.0 μm to not more than 9.0 μm.

Examples of methods for producing the magnetic toner of the present invention are provided below, but there is no intent to limit the production method to these.

The magnetic toner of the present invention can be produced by any known production method that has a step or steps that enable adjustment of the coverage ratio A, coefficient of variation on the coverage ratio A, and B/A, while the other production steps are not particularly limited.

The following method is a favorable example of such a production method. First, the binder resin, release agent, and magnetic body and as necessary other raw materials, e.g., a charge control agent, are thoroughly mixed using a mixer such as a HENSCHEL™ MIXER or ball mill and are then melted, worked, and kneaded using a heated kneading apparatus such as a roll, kneader, or extruder to compatibilize the resins with each other.

The obtained melted and kneaded material is cooled and solidified and then coarsely pulverized, finely pulverized, and classified, and the external additives, e.g., inorganic fine particles, are externally added and mixed into the resulting magnetic toner particles to obtain the magnetic toner.

The mixer used here can be exemplified by the HENSCHEL™ MIXER (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); Loedige Mixer (Matsubo Corporation); and Nobilta (Hosokawa Micron Corporation).

The aforementioned kneading apparatus can be exemplified by the KRC Kneader (Kurimoto, Ltd.); Buss Ko-Kneader (Buss Corp.); TEM extruder (Toshiba Machine Co., Ltd.); TEX twin-screw kneader (The Japan Steel Works, Ltd.); PCM Kneader (Ikegai Ironworks Corporation); three-roll mills, mixing roll mills, kneaders (Inoue Manufacturing Co., Ltd.); Kneadex (Mitsui Mining Co., Ltd.); model MS pressure kneader and Kneader-Ruder (Moriyama Mfg. Co., Ltd.); and Banbury mixer (Kobe Steel, Ltd.).

The aforementioned pulverizer can be exemplified by the Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

The aforementioned classifier can be exemplified by the Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow Jet (Nittetsu Mining Co., Ltd.); Dispersion Separator (Nippon Pneumatic Mfg. Co., Ltd.); and YM Microcut (Yasukawa Shoji Co., Ltd.).

Screening devices that can be used to screen the coarse particles can be exemplified by the Ultrasonic (Koei Sangyo Co., Ltd.), Rezona Sieve and Gyro-Sifter (Tokuju Corporation), Vibrasonic System (Dalton Co., Ltd.), Soniclean (Sintokogio, Ltd.), Turbo Screener (Turbo Kogyo Co., Ltd.), Microsifter (Makino Mfg. Co., Ltd.), and circular vibrating sieves.

Figure 4:
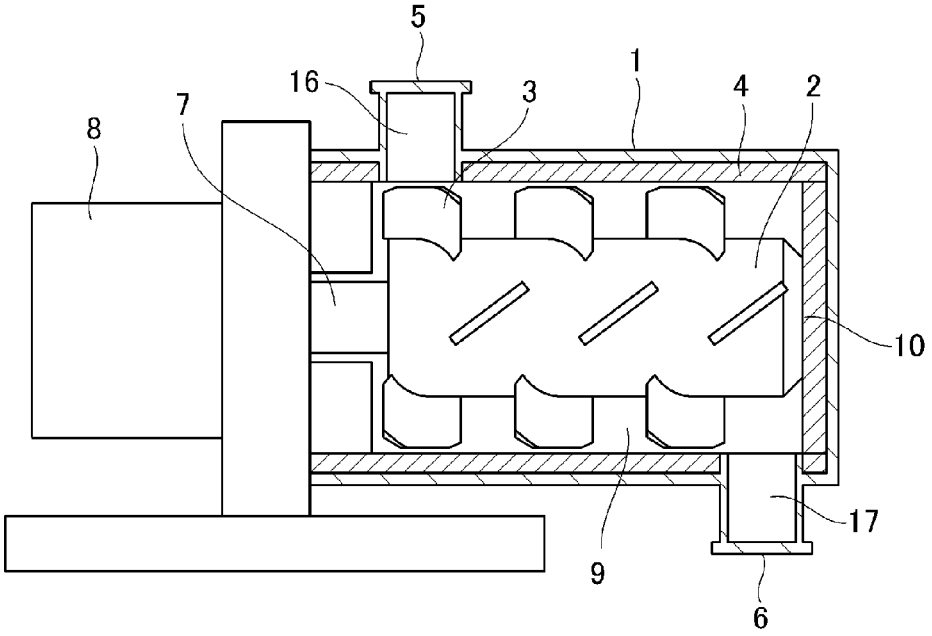
FIG. 4 is a schematic diagram that shows an example of a mixing process apparatus that can be used for the external addition and mixing of inorganic fine particles.

A known mixing process apparatus, e.g., the mixers described above, can be used for the external addition and mixing of the inorganic fine particles; however, an apparatus as shown in FIG. 4 is preferred from the standpoint of enabling facile control of the coverage ratio A, B/A, and the coefficient of variation on the coverage ratio A.

FIG. 4 is a schematic diagram that shows an example of a mixing process apparatus that can be used to carry out the external addition and mixing of the inorganic fine particles used by the present invention.

This mixing process apparatus readily brings about fixing of the inorganic fine particles to the magnetic toner particle surface because it has a structure that applies shear in a narrow clearance region to the magnetic toner particles and the inorganic fine particles.

Furthermore, as described below, the coverage ratio A, B/A, and coefficient of variation on the coverage ratio A are easily controlled into the ranges preferred for the present invention because circulation of the magnetic toner particles and inorganic fine particles in the axial direction of the rotating member is facilitated and because a thorough and uniform mixing is facilitated prior to the development of fixing.

Figure 5:
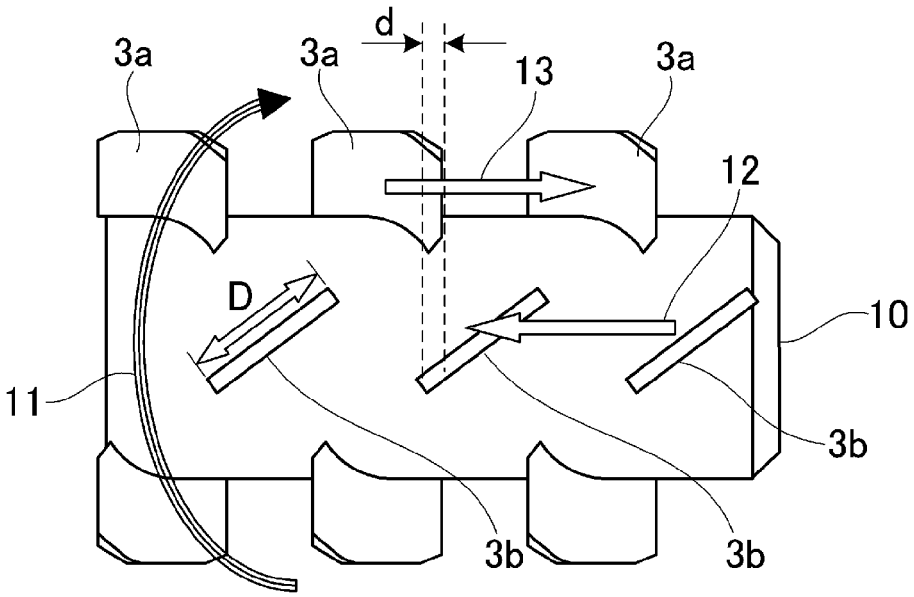
FIG. 5 is a schematic diagram that shows an example of the structure of a stirring member used in the mixing process apparatus.

On the other hand, FIG. 5 is a schematic diagram that shows an example of the structure of the stirring member used in the aforementioned mixing process apparatus.

The external addition and mixing process for the inorganic fine particles is described below using FIGS. 4 and 5.

This mixing process apparatus that carries out external addition and mixing of the inorganic fine particles has a rotating member 2, on the surface of which at least a plurality of stirring members 3 are disposed; a drive member 8, which drives the rotation of the rotating member; and a main casing 1, which is disposed to have a gap with the stirring members 3.

It is important that the gap (clearance) between the inner circumference of the main casing 1 and the stirring member 3 be maintained constant and very small in order to apply a uniform shear to the magnetic toner particles and facilitate the fixing of the inorganic fine particles to the magnetic toner particle surface.

The diameter of the inner circumference of the main casing 1 in this apparatus is not more than twice the diameter of the outer circumference of the rotating member 2. In FIG. 4, an example is shown in which the diameter of the inner circumference of the main casing 1 is 1.7-times the diameter of the outer circumference of the rotating member 2 (the trunk diameter provided by subtracting the stirring member 3 from the rotating member 2). When the diameter of the inner circumference of the main casing 1 is not more than twice the diameter of the outer circumference of the rotating member 2, impact force is satisfactorily applied to the magnetic toner particles since the processing space in which forces act on the magnetic toner particles is suitably limited.

In addition, it is important that the aforementioned clearance be adjusted in conformity to the size of the main casing. Viewed from the standpoint of the application of adequate shear to the magnetic toner particles, it is important that the clearance be made from about at least 1% to not more than 5% of the diameter of the inner circumference of the main casing 1. Specifically, when the diameter of the inner circumference of the main casing 1 is approximately 130 mm, the clearance is preferably made approximately from at least 2 mm to not more than 5 mm; when the diameter of the inner circumference of the main casing 1 is about 800 mm, the clearance is preferably made approximately from at least 10 mm to not more than 30 mm.

In the process of the external addition and mixing of the inorganic fine particles in the present invention, mixing and external addition of the inorganic fine particles to the magnetic toner particle surface are performed using the mixing process apparatus by rotating the rotating member 2 by the drive member 8 and stirring and mixing the magnetic toner particles and inorganic fine particles that have been introduced into the mixing process apparatus.

As shown in FIG. 5, at least a portion of the plurality of stirring members 3 is formed as a forward transport stirring member 3*a* that, accompanying the rotation of the rotating member 2, transports the magnetic toner particles and inorganic fine particles in one direction along the axial direction of the rotating member. In addition, at least a portion of the plurality of stirring members 3 is formed as a back transport stirring member 3*b* that, accompanying the rotation of the rotating member 2, returns the magnetic toner particles and inorganic fine particles in the other direction along the axial direction of the rotating member.

Here, when the raw material inlet port 5 and the product discharge port 6 are disposed at the two ends of the main casing 1, as in FIG. 4, the direction toward the product discharge port 6 from the raw material inlet port 5 (the direction to the right in FIG. 4) is the "forward direction".

That is, as shown in FIG. 5, the face of the forward transport stirring member 3*a* is tilted so as to transport the magnetic toner particles in the forward direction (13). On the other hand, the face of the back transport stirring member 3*b* is tilted so as to transport the magnetic toner particles and the inorganic fine particles in the back direction (12).

By doing this, the external addition of the inorganic fine particles to the surface of the magnetic toner particles and mixing are carried out while repeatedly performing transport in the "forward direction" (13) and transport in the "back direction" (12).

In addition, with regard to the stirring members 3*a*, 3*b*, a plurality of members disposed at intervals in the circumferential direction of the rotating member 2 form a set. In the example shown in FIG. 5, two members at an interval of 180° with each other form a set of the stirring members 3*a*, 3*b* on the rotating member 2, but a larger number of members may form a set, such as three at an interval of 120° or four at an interval of 90°.

In the example shown in FIG. 5, a total of twelve stirring members 3*a*, 3*b* are formed at an equal interval.

Furthermore, D in FIG. 5 indicates the width of a stirring member and d indicates the distance that represents the overlapping portion of a stirring member. In FIG. 5, D is preferably a width that is approximately from at least 20% to not more than 30% of the length of the rotating member 2, when considered from the standpoint of bringing about an efficient transport of the magnetic toner particles and inorganic fine particles in the forward direction and back direction. FIG. 5 shows an example in which D is 23%. Furthermore, with regard to the stirring members 3*a* and 3*b*, when an extension line is drawn in the perpendicular direction from the location of the end of the stirring member 3*a*, a certain overlapping portion d of the stirring member with the stirring member 3*b* is preferably present. This serves to efficiently apply shear to the magnetic toner particles. This d is preferably from at least 10% to not more than 30% of D from the standpoint of the application of shear.

In addition to the shape shown in FIG. 5, the blade shape may be—insofar as the magnetic toner particles can be transported in the forward direction and back direction and the clearance is retained—a shape having a curved surface or a paddle structure in which a distal blade element is connected to the rotating member 2 by a rod-shaped arm.

The present invention will be described in additional detail herebelow with reference to the schematic diagrams of the apparatus shown in FIGS. 4 and 5.

The apparatus shown in FIG. 4 has a rotating member 2, which has at least a plurality of stirring members 3 disposed on its surface; a drive member 8 that drives the rotation of the rotating member 2; a main casing 1, which is disposed forming a gap with the stirring members 3; and a jacket 4, in which a heat transfer medium can flow and which resides on the inside of the main casing 1 and at the end surface 10 of the rotating member.

In addition, the apparatus shown in FIG. 4 has a raw material inlet port 5, which is formed on the upper side of the main casing 1 for the purpose of introducing the magnetic toner particles and the inorganic fine particles, and a product discharge port 6, which is formed on the lower side of the main casing 1 for the purpose of discharging, from the main casing to the outside, the magnetic toner that has been subjected to the external addition and mixing process.

The apparatus shown in FIG. 4 also has a raw material inlet port inner piece 16 inserted in the raw material inlet port 5 and a product discharge port inner piece 17 inserted in the product discharge port 6.

In the present invention, the raw material inlet port inner piece 16 is first removed from the raw material inlet port 5 and the magnetic toner particles are introduced into the processing space 9 from the raw material inlet port 5. Then, the inorganic fine particles are introduced into the processing space 9 from the raw material inlet port 5 and the raw material inlet port inner piece 16 is inserted. The rotating member 2 is subsequently rotated by the drive member 8 (11 represents the direction of rotation), and the thereby introduced material to be processed is subjected to the external addition and mixing process while being stirred and mixed by the plurality of stirring members 3 disposed on the surface of the rotating member 2.

The sequence of introduction may also be introduction of the inorganic fine particles through the raw material inlet port 5 first and then introduction of the magnetic toner particles through the raw material inlet port 5. In addition, the magnetic toner particles and the inorganic fine particles may be mixed in advance using a mixer such as a HENSCHEL™ MIXER and the mixture may thereafter be introduced through the raw material inlet port 5 of the apparatus shown in FIG. 4.

More specifically, with regard to the conditions for the external addition and mixing process, controlling the power of the drive member 8 to from at least 0.2 W/g to not more than 2.0 W/g is preferred in terms of obtaining the coverage ratio A, B/A, and coefficient of variation on the coverage ratio A specified by the present invention. Controlling the power of the drive member 8 to from at least 0.6 W/g to not more than 1.6 W/g is more preferred.

When the power is lower than 0.2 W/g, it is difficult to obtain a high coverage ratio A, and B/A tends to be too low. On the other hand, B/A tends to be too high when 2.0 W/g is exceeded.

The processing time is not particularly limited, but is preferably from at least 3 minutes to not more than 10 minutes. When the processing time is shorter than 3 minutes, B/A tends to be low and a large coefficient of variation on the coverage ratio A is prone to occur. On the other hand, when the processing time exceeds 10 minutes, B/A conversely tends to be high and the temperature within the apparatus is prone to rise.

The rotation rate of the stirring members during external addition and mixing is not particularly limited; however, when, for the apparatus shown in FIG. 4, the volume of the processing space 9 in the apparatus is $2.0\times10^{-3}$ $m^3$, the rpm of the stirring members—when the shape of the stirring members 3 is as shown in FIG. 5—is preferably from at least 1000 rpm to not more than 3000 rpm. The coverage ratio A, B/A, and coefficient of variation on the coverage ratio A as specified for the present invention are readily obtained at from at least 1000 rpm to not more than 3000 rpm.

A particularly preferred processing method for the present invention has a pre-mixing step prior to the external addition and mixing process step. Inserting a pre-mixing step achieves a very uniform dispersion of the inorganic fine particles on the magnetic toner particle surface, and as a result a high coverage ratio A is readily obtained and the coefficient of variation on the coverage ratio A is readily reduced.

More specifically, the pre-mixing processing conditions are preferably a power of the drive member 8 of from at least 0.06 W/g to not more than 0.20 W/g and a processing time of from at least 0.5 minutes to not more than 1.5 minutes. It is difficult to obtain a satisfactorily uniform mixing in the pre-mixing when the loaded power is below 0.06 W/g or the processing time is shorter than 0.5 minutes for the pre-mixing processing conditions. When, on the other hand, the loaded power is higher than 0.20 W/g or the processing time is longer than 1.5 minutes for the pre-mixing processing conditions, the inorganic fine particles may become fixed to the magnetic toner particle surface before a satisfactorily uniform mixing has been achieved.

After the external addition and mixing process has been finished, the product discharge port inner piece 17 in the product discharge port 6 is removed and the rotating member 2 is rotated by the drive member 8 to discharge the magnetic toner from the product discharge port 6. As necessary, coarse particles and so forth may be separated from the obtained magnetic toner using a screen or sieve, for example, a circular vibrating screen, to obtain the magnetic toner.

Figure 6:
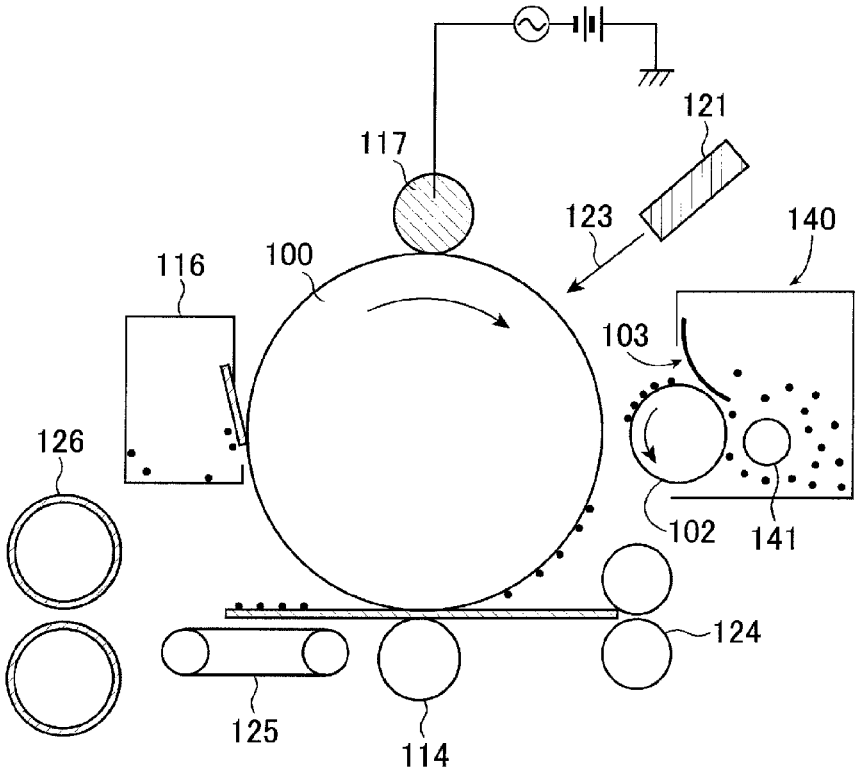
FIG. 6 is a diagram that shows an example of an image-forming apparatus.

An example of an image-forming apparatus that can advantageously use the toner of the present invention is specifically described below with reference to FIG. 6. In FIG. 6, 100 is an electrostatic latent image-bearing member (also referred to below as a photosensitive member), and the following, inter alia, are disposed on its circumference: a charging member (charging roller) 117, a developing device 140 having a toner-carrying member 102, a transfer member (transfer charging roller) 114, a cleaner container 116, a fixing unit 126, and a pick-up roller 124. The electrostatic latent image-bearing member 100 is charged by the charging roller 117. Photoexposure is performed by irradiating the electrostatic latent image-bearing member 100 with laser light from a laser generator 121 to form an electrostatic latent image corresponding to the intended image. The electrostatic latent image on the electrostatic latent image-bearing member 100 is developed by the developing device 140 with a monocomponent toner to provide a toner image, and the toner image is transferred onto a transfer material by the transfer roller 114, which contacts the electrostatic latent image-bearing member with the transfer material interposed therebetween. The toner image-bearing transfer material is conveyed to the fixing unit 126 and fixing on the transfer material is carried out. In addition, the toner remaining to some extent on the electrostatic latent image-bearing member is scraped off by the cleaning blade and is stored in the cleaner container 116.

The methods for measuring the various properties referenced by the present invention are described below.

<Calculation of the Coverage Ratio A>

The coverage ratio A is calculated in the present invention by analyzing, using Image-Pro Plus ver. 5.0 image analysis software (Nippon Roper Kabushiki Kaisha), the image of the magnetic toner surface taken with Hitachi's S-4800 ultrahigh resolution field emission scanning electron microscope (Hitachi High-Technologies Corporation). The conditions for image acquisition with the S-4800 are as follows.

(1) Specimen Preparation

An electroconductive paste is spread in a thin layer on the specimen stub (15 mm×6 mm aluminum specimen stub) and the magnetic toner is sprayed onto this. Additional blowing with air is performed to remove excess magnetic toner from the specimen stub and carry out thorough drying. The specimen stub is set in the specimen holder and the specimen stub height is adjusted to 36 mm with the specimen height gauge.

(2) Setting the Conditions for Observation with the S-4800

The coverage ratio A is calculated using the image obtained by backscattered electron imaging with the S-4800. The coverage ratio A can be measured with excellent accuracy using the backscattered electron image because the inorganic fine particles are charged up less than is the case with the secondary electron image.

Introduce liquid nitrogen to the brim of the anti-contamination trap located in the S-4800 housing and allow to stand for 30 minutes. Start the "PC-SEM" of the S-4800 and perform flashing (the FE tip, which is the electron source, is cleaned). Click the acceleration voltage display area in the control panel on the screen and press the [flashing] button to open the flashing execution dialog. Confirm a flashing intensity of 2 and execute. Confirm that the emission current due to flashing is 20 to 40 μA. Insert the specimen holder in the specimen chamber of the S-4800 housing. Press [home] on the control panel to transfer the specimen holder to the observation position.

Click the acceleration voltage display area to open the HV setting dialog and set the acceleration voltage to [0.8 kV] and the emission current to [20 μA]. In the [base] tab of the operation panel, set signal selection to [SE]; select [upper (U)] and [+BSE] for the SE detector; and select [L.A. 100] in the selection box to the right of [+BSE] to go into the observation mode using the backscattered electron image. Similarly, in the [base] tab of the operation panel, set the probe current of the electron optical system condition block to [Normal]; set the focus mode to [UHR]; and set WD to [3.0 mm]. Push the [ON] button in the acceleration voltage display area of the control panel and apply the acceleration voltage.

(3) Calculation of the Number-Average Particle Diameter (D1) of the Magnetic Toner Set the magnification to 5000× (5 k) by dragging within the magnification indicator area of the control panel. Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus with the autofocus. Focus by repeating this operation an additional two times.

After this, determine the number-average particle diameter (D1) by measuring the particle diameter at 300 magnetic toner particles. The particle diameter of the individual particle is taken to be the maximum diameter when the magnetic toner particle is observed.

(4) Focus Adjustment

For particles with a number-average particle diameter (D1) obtained in (3) of ±0.1 μm, with the center of the maximum diameter adjusted to the center of the measurement screen, drag within the magnification indication area of the control panel to set the magnification to 10000× (10 k). Turn the [COARSE] focus knob on the operation panel and perform adjustment of the aperture alignment where some degree of focus has been obtained. Click [Align] in the control panel and display the alignment dialog and select [beam]. Migrate the displayed beam to the center of the concentric circles by turning the STIGMA/ALIGNMENT knobs (X, Y) on the operation panel. Then select [aperture] and turn the STIGMA/ALIGNMENT knobs (X, Y) one at a time and adjust so as to stop the motion of the image or minimize the motion. Close the aperture dialog and focus using autofocus. Then set the magnification to 50000× (50 k); carry out focus adjustment as above using the focus knob and the STIGMA/ALIGNMENT knob; and re-focus using autofocus. Focus by repeating this operation. Here, because the accuracy of the coverage ratio measurement is prone to decline when the observation plane has a large tilt angle, carry out the analysis by making a selection with the least tilt in the surface by making a selection during focus adjustment in which the entire observation plane is simultaneously in focus.

(5) Image Capture

Carry out brightness adjustment using the ABC mode and take a photograph with a size of 640×480 pixels and store. Carry out the analysis described below using this image file. Take one photograph for each magnetic toner particle and obtain images for at least 30 magnetic toner particles.

(6) Image Analysis

The coverage ratio A is calculated in the present invention using the analysis software indicated below by subjecting the image obtained by the above-described procedure to binarization processing. When this is done, the above-described single image is divided into 12 squares and each is analyzed. However, when an inorganic fine particle with a particle diameter greater than or equal to 50 nm is present within a partition, calculation of the coverage ratio A is not performed for this partition.

The analysis conditions with the Image-Pro Plus ver. 5.0 image analysis software are as follows.

Software: Image-ProPlus5.1J

From "measurement" in the tool-bar, select "count/size" and then "option" and set the binarization conditions. Select 8 links in the object extraction option and set smoothing to 0. In addition, preliminary screening, fill vacancies, and envelope are not selected and the "exclusion of boundary line" is set to "none". Select "measurement items" from "measurement" in the tool-bar and enter 2 to $10^7$ for the area screening range.

The coverage ratio is calculated by marking out a square zone. Here, the area (C) of the zone is made 24000 to 26000 pixels. Automatic binarization is performed by "processing"-binarization and the total area (D) of the silica-free zone is calculated.

The coverage ratio a is calculated using the following formula from the area C of the square zone and the total area D of the silica-free zone.

$$\text{coverage ratio } a\ (\%)=100-(D/C\times 100)$$

As noted above, calculation of the coverage ratio a is carried out for at least 30 magnetic toner particles. The average value of all the obtained data is taken to be the coverage ratio A of the present invention.

<The Coefficient of Variation on the Coverage Ratio A>

The coefficient of variation on the coverage ratio A is determined in the present invention as follows. The coefficient of variation on the coverage ratio A is obtained using the following formula letting σ(A) be the standard deviation on all the coverage ratio data used in the calculation of the coverage ratio A described above.

$$\text{coefficient of variation } (\%)=\{\sigma(A)/A\}\times 100$$

<Calculation of the Coverage Ratio B>

The coverage ratio B is calculated by first removing the unfixed inorganic fine particles on the magnetic toner surface and thereafter carrying out the same procedure as followed for the calculation of the coverage ratio A.

(1) Removal of the Unfixed Inorganic Fine Particles

The unfixed inorganic fine particles are removed as described below. The present inventors investigated and then set these removal conditions in order to thoroughly remove the inorganic fine particles other than those embedded in the toner surface.

Figure 7:
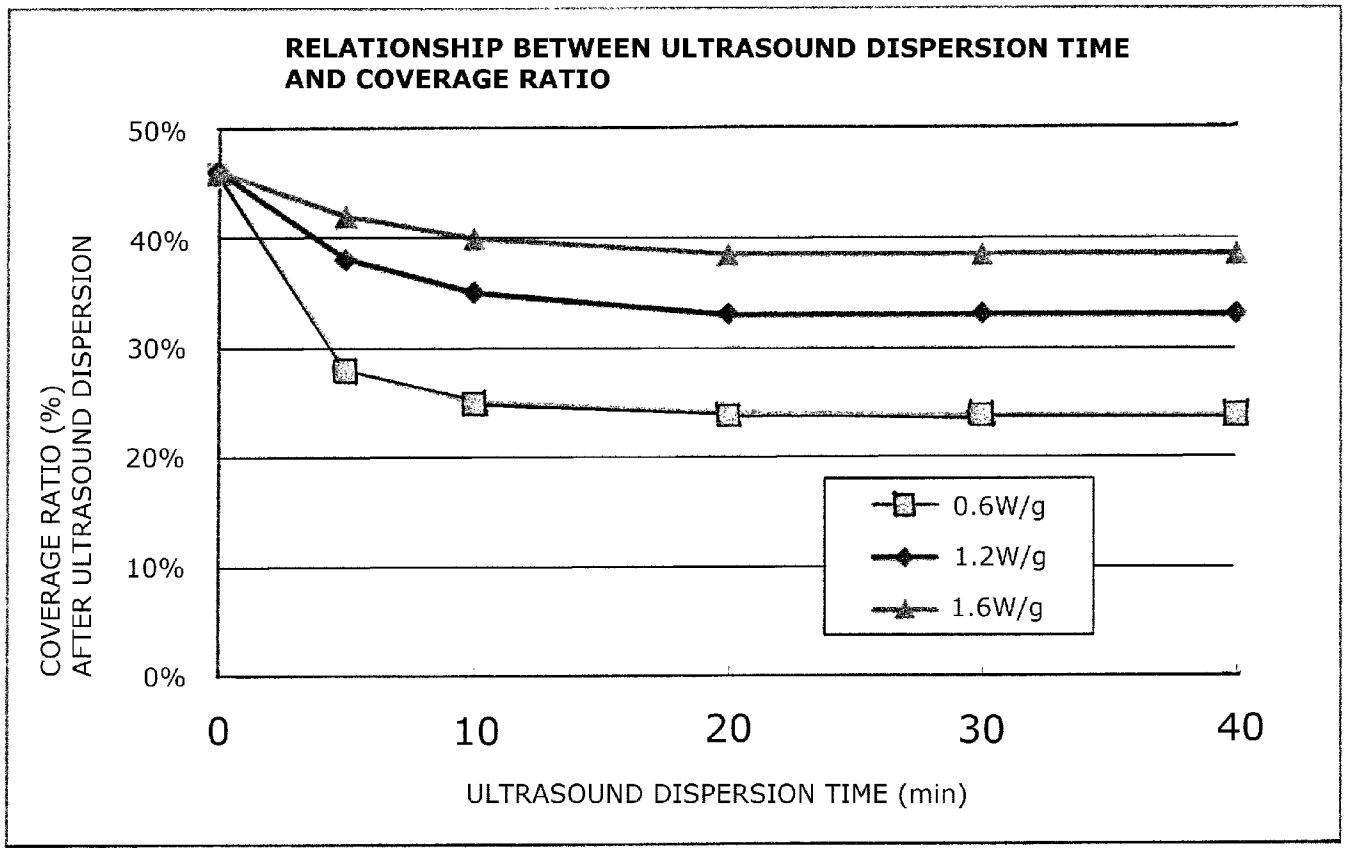
FIG. 7 is a diagram that shows an example of the relationship between the ultrasound dispersion time and the coverage ratio.

As an example, FIG. 7 shows the relationship between the ultrasound dispersion time and the coverage ratio calculated post-ultrasound dispersion, for magnetic toners in which the coverage ratio A was brought to 46% using the apparatus shown in FIG. 4 at three different external addition intensities. FIG. 7 was constructed by calculating, using the same procedure as for the calculation of coverage ratio A as described above, the coverage ratio of a magnetic toner provided by removing the inorganic fine particles by ultrasound dispersion by the method described below and then drying.

FIG. 7 demonstrates that the coverage ratio declines in association with removal of the inorganic fine particles by ultrasound dispersion and that, for all of the external addition intensities, the coverage ratio is brought to an approximately constant value by ultrasound dispersion for 20 minutes. Based on this, ultrasound dispersion for 30 minutes was regarded as providing a thorough removal of the inorganic fine particles other than the inorganic fine particles embedded in the toner surface and the thereby obtained coverage ratio was defined as coverage ratio B.

Considered in greater detail, 16.0 g of water and 4.0 g of Contaminon N (a neutral detergent from Wako Pure Chemical Industries, Ltd., product No. 037-10361) are introduced into a 30 mL glass vial and are thoroughly mixed. 1.50 g of the magnetic toner is introduced into the resulting solution and the magnetic toner is completely submerged by applying a magnet at the bottom. After this, the magnet is moved around in order to condition the magnetic toner to the solution and remove air bubbles.

The tip of a UH-50 ultrasound oscillator (from SMT Co., Ltd., the tip used is a titanium alloy tip with a tip diameter ϕ of 6 mm) is inserted so it is in the center of the vial and resides at a height of 5 mm from the bottom of the vial, and the inorganic fine particles are removed by ultrasound dispersion. After the application of ultrasound for 30 minutes, the entire amount of the magnetic toner is removed and dried. During this time, as little heat as possible is applied while carrying out vacuum drying at not more than 30° C.

(2) Calculation of the Coverage Ratio B

After the drying as described above, the coverage ratio of the magnetic toner is calculated as for the coverage ratio A described above, to obtain the coverage ratio B.

<Quantitation Methods for the Inorganic Fine Particles>

(1) Determination of the Content of Silica Fine Particles in the Magnetic Toner (Standard Addition Method)

3 g of the magnetic toner is introduced into an aluminum ring having a diameter of 30 mm and a pellet is prepared using a pressure of 10 tons. The silicon (Si) intensity is determined (Si intensity-1) by wavelength-dispersive x-ray fluorescence analysis (XRF). The measurement conditions are preferably optimized for the XRF instrument used and all of the intensity measurements in a series are performed using the same conditions. Silica fine particles with a primary particle number-average particle diameter of 12 nm are added to the magnetic toner at 1.0 mass % with reference to the magnetic toner and mixing is carried out with a coffee mill.

For the silica fine particles admixed at this time, silica fine particles with a primary particle number-average particle diameter of from at least 5 nm to not more than 50 nm can be used without affecting this determination.

After mixing, pellet fabrication is carried out as described above and the Si intensity (Si intensity-2) is determined also as described above. Using the same procedure, the Si intensity (Si intensity-3, Si intensity-4) is also determined for samples prepared by adding and mixing the silica fine particles at 2.0 mass % and 3.0 mass % of the silica fine particles with reference to the magnetic toner. The silica content (mass %) in the magnetic toner based on the standard addition method is calculated using Si intensities-1 to -4.

The titania content (mass %) in the magnetic toner and the alumina content (mass %) in the magnetic toner are determined using the standard addition method and the same procedure as described above for the determination of the silica content. That is, for the titania content (mass %), titania fine particles with a primary particle number-average particle diameter of from at least 5 nm to not more than 50 nm are added and mixed and the determination can be made by determining the titanium (Ti) intensity. For the alumina content (mass %), alumina fine particles with a primary particle number-average particle diameter of from at least 5 nm to not more than 50 nm are added and mixed and the determination can be made by determining the aluminum (Al) intensity.

(2) Separation of the Inorganic Fine Particles from the Magnetic Toner 5 g of the magnetic toner is weighed using a precision balance into a lidded 200-mL plastic cup; 100 mL methanol is added; and dispersion is carried out for 5 minutes using an ultrasound disperser. The magnetic toner is held using a neodymium magnet and the supernatant is discarded. The process of dispersing with methanol and discarding the supernatant is carried out three times, followed by the addition of 100 mL of 10% NaOH and several drops of "Contaminon N" (a 10 mass % aqueous solution of a neutral pH 7 detergent for cleaning precision measurement instrumentation and comprising a nonionic surfactant, an anionic surfactant, and an organic builder, from Wako Pure Chemical Industries, Ltd.), light mixing, and then standing at quiescence for 24 hours. This is followed by re-separation using a neodymium magnet. Repeated washing with distilled water is carried out at this point until NaOH does not remain. The recovered particles are thoroughly dried using a vacuum drier to obtain particles A. The externally added silica fine particles are dissolved and removed by this process. Titania fine particles and alumina fine particles can remain present in particles A since they are sparingly soluble in 10% NaOH.

(3) Measurement of the Si Intensity in the Particles A 3 g of the particles A are introduced into an aluminum ring with a diameter of 30 mm; a pellet is fabricated using a pressure of 10 tons; and the Si intensity (Si intensity-5) is determined by wavelength-dispersive XRF. The silica content (mass %) in particles A is calculated using the Si intensity-5 and the Si intensities-1 to −4 used in the determination of the silica content in the magnetic toner.

(4) Separation of the Magnetic Body from the Magnetic Toner 100 mL of tetrahydrofuran is added to 5 g of the particles A with thorough mixing followed by ultrasound dispersion for 10 minutes. The magnetic body is held with a magnet and the supernatant is discarded. This process is performed 5 times to obtain particles B. This process can almost completely remove the organic component, e.g., resins, outside the magnetic body. However, because a tetrahydrofuran-insoluble matter in the resin can remain, the particles B provided by this process are preferably heated to 800° C. in order to burn off the residual organic component, and the particles C obtained after heating are approximately the magnetic body that was present in the magnetic toner.

Measurement of the mass of the particles C yields the magnetic body content W (mass %) in the magnetic toner. In order to correct for the increment due to oxidation of the magnetic body, the mass of particles C is multiplied by 0.9666 ($Fe_2O_3 \rightarrow Fe_3O_4$).

(5) Measurement of the Ti Intensity and Al Intensity in the Separated Magnetic Body Ti and Al may be present as impurities or additives in the magnetic body. The amount of Ti and Al attributable to the magnetic body can be detected by FP quantitation in wavelength-dispersive XRF. The detected amounts of Ti and Al are converted to titania and alumina and the titania content and alumina content in the magnetic body are then calculated.

The amount of externally added silica fine particles, the amount of externally added titania fine particles, and the amount of externally added alumina fine particles are calculated by substituting the quantitative values obtained by the preceding procedures into the following formulas.

amount of externally added silica fine particles (mass %)=silica content (mass %) in the magnetic toner−silica content (mass %) in particle *A* amount of externally added titania fine particles (mass %)=titania content (mass %) in the magnetic toner−{titania content (mass %) in the magnetic body×magnetic body content *W*/100} amount of externally added alumina fine particles (mass %)=alumina content (mass %) in the magnetic toner−{alumina content (mass %) in the magnetic body×magnetic body content *W*/100}

(6) Calculation of the Proportion of Silica Fine Particles in the Metal Oxide Fine Particles Selected from the Group Consisting of Silica Fine Particles, Titania Fine Particles, and Alumina Fine Particles, for the Inorganic Fine Particles Fixed to the Magnetic Toner Particle Surface After carrying out the procedure, "Removing the unfixed inorganic fine particles", in the method for calculating the coverage ratio B and thereafter drying the toner, the proportion of the silica fine particles in the metal oxide fine particles can be calculated by carrying out the same procedures as in the method of (1) to (5) described above.

<Method of Measuring the Number-Average Particle Diameter of the Primary Particles of the Inorganic Fine Particles>

The number-average particle diameter of the primary particles of the inorganic fine particles is calculated from the inorganic fine particle image on the magnetic toner surface taken with Hitachi's S-4800 ultrahigh resolution field emission scanning electron microscope (Hitachi High-Technologies Corporation). The conditions for image acquisition with the S-4800 are as follows.

The same steps (1) to (3) as described above in "Calculation of the coverage ratio A" are carried out; focusing is performed by carrying out focus adjustment at a 50000× magnification of the magnetic toner surface as in (4); and the brightness is then adjusted using the ABC mode. This is followed by bringing the magnification to 100000×; performing focus adjustment using the focus knob and STIGMA/ALIGNMENT knobs as in (4); and focusing autofocus. The focus adjustment process is repeated to achieve focus at 100000×.

After this, the particle diameter is measured on at least 300 inorganic fine particles on the magnetic toner surface and the number-average particle diameter (D1) is determined. Here, because the inorganic fine particles are also present as aggregates, the maximum diameter is determined on what can be identified as the primary particle, and the primary particle number-average particle diameter (D1) is obtained by taking the arithmetic average of the obtained maximum diameters.

<Method for Measuring the Weight-Average Particle Diameter (D4) and Particle Size Distribution of the Magnetic Toner>

The weight-average particle diameter (D4) of the magnetic toner is calculated as follows. The measurement instrument used is a "Coulter Counter Multisizer 3" (registered trademark, from Beckman Coulter, Inc.), a precision particle size distribution measurement instrument operating on the pore electrical resistance principle and equipped with a 100 μm aperture tube. The measurement conditions are set and the measurement data are analyzed using the accompanying dedicated software, i.e., "Beckman Coulter Multisizer 3 Version 3.51" (from Beckman Coulter, Inc.). The measurements are carried at 25000 channels for the number of effective measurement channels.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50000 particles; the number of measurements is set to 1 time; and the Kd value is set to the value obtained using "standard particle 10.0 μm" (from Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the dedicated software.

(2) Approximately 30 mL of the above-described aqueous electrolyte solution is introduced into a 100-mL flatbottom glass beaker. To this is added as dispersant about 0.3 mL of a dilution prepared by the approximately three-fold (mass) dilution with ion-exchanged water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

(3) An "Ultrasonic Dispersion System Tetora 150" (Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of ion-exchanged water is introduced into the water tank of this ultrasound disperser and approximately 2 mL of Contaminon N is added to the water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of about 5%. Measurement is then performed until the number of measured particles reaches 50000.

(7) The measurement data is analyzed by the previously cited software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

<Method for Measuring the Peak Molecular Weight (Mp) of the Resins>

The peak molecular weight of the resins is measured using gel permeation chromatography (GPC) under the following conditions.

The column is stabilized in a heated chamber at 40° C., and tetrahydrofuran (THF) is introduced as solvent at a flow rate of 1 mL per minute into the column at this temperature. For the column, a combination of a plurality of commercially available polystyrene gel columns is favorably used to accurately measure the molecular weight range of $1\times10^3$ to $2\times10^6$. Examples here are the combination of Shodex GPC KF-801, 802, 803, 804, 805, 806, 807, and 800P from Showa Denko Kabushiki Kaisha and the combination of TSKgel G1000H(HXL), G2000H(HXL), G3000H(HXL), G4000H(HXL), G5000H(HXL), G6000H(HXL), G7000H(HXL), and TSKguard column from Tosoh Corporation, while a 7-column train of Shodex KF-801, 802, 803, 804, 805, 806, and 807 from Showa Denko Kabushiki Kaisha is preferred.

On the other hand, the resin is dispersed and dissolved in THF and allowed to stand overnight and is then filtered on a sample treatment filter (for example, a MyShoriDisk H-25-2 with a pore size of 0.2 to 0.5 μm (Tosoh Corporation)) and the filtrate is used for the sample. 50 to 200 μL of the THF solution of the resin, which has been adjusted to bring the resin component to 0.5 to 5 mg/mL for the sample concentration, is injected to carry out the measurement. An RI (refractive index) detector is used for the detector.

To measure the molecular weight of the sample, the molecular weight distribution possessed by the sample is calculated from the relationship between the number of counts and the logarithmic value on a calibration curve constructed using several different monodisperse polystyrene standard samples. The standard polystyrene samples used to construct the calibration curve can be exemplified by samples with a molecular weight of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, and $4.48\times10^6$ from the Pressure Chemical Company or Tosoh Corporation, and standard polystyrene samples at approximately 10 points or more are suitably used.

<Method for Measuring the Endothermic Peak and Endothermic Peak Amount of Heat of the Magnetic Toner and the Melting Point of the Ester Compound>

The endothermic peak and endothermic peak amount of heat of the magnetic toner and the melting point of the release agent (ester compound) are measured based on ASTM D 3418-82 using a DSC-7 (PerkinElmer Inc.) differential scanning calorimeter (DSC measurement instrument).

For the measurement sample, from at least 5 mg to not more than 20 mg and preferably 10 mg is accurately weighed out.

This is placed in an aluminum pan and the measurement is carried out at normal temperature and normal humidity at a rate of temperature rise of 10° C./min in the measurement temperature range of 30 to 200° C. using an empty aluminum pan for reference. The measurement is performed by raising the temperature to 200° C. at a rate of temperature rise of 10° C./min, then lowering the temperature to 30° C. at 10° C./min, and thereafter raising the temperature once again at a rate of temperature rise of 10° C./min. The maximum endothermic peak in the 40 to 120° C. temperature range in this second temperature ramp-up step is obtained.

When the measurement sample is the magnetic toner, the maximum endothermic peak is taken to be the endothermic peak of the magnetic toner. In addition, the peak temperature of the maximum endothermic peak is taken to be the temperature of the endothermic peak of the magnetic toner.

The endothermic peak amount of heat (J/g) is calculated in the temperature region in which this endothermic peak appears from the area bounded by the baseline for the differential scanning calorimetric (DSC) curve and the differential scanning calorimetric (DSC) curve.

On the other hand, when the release agent (ester compound) is the measurement sample, the peak temperature of the maximum endothermic peak is taken to be the melting point of the release agent (ester compound).

<Method of Measuring the Magnetic Characteristics of the Magnetic Toner and Magnetic Body>

The magnetic characteristics of the magnetic toner and magnetic body are measured at a room temperature of 25° C. and an external magnetic field of 79.6 kA/m using a VSM P-1-10 vibrating sample magnetometer (Toei Industry Co., Ltd.).

<Method for Measuring the Acid Value of the Resins and Magnetic Toner>

The acid value is determined in the present invention using the following procedure. The basic procedure falls under JIS K 0070.

The measurement is carried out using a potentiometric titration apparatus for the measurement instrumentation. An automatic titration can be used for this titration using an AT-400 (winworkstation) potentiometric titration apparatus and APB-410 piston burette from Kyoto Electronics Manufacturing Co., Ltd.

The instrument is calibrated using a mixed solvent of 120 mL toluene and 30 mL ethanol. 25° C. is used for the measurement temperature.

The sample is prepared by introducing 1.0 g of the magnetic toner or 0.5 g of the resin into a mixed solvent of 120 mL toluene and 30 mL ethanol followed by dispersion for 10 minutes by ultrasound dispersion. A magnetic stirrer is introduced and stirring and dissolution are carried out for about 10 hours while covered. A blank test is performed using an ethanol solution of 0.1 mol/L potassium hydroxide. The amount of ethanolic potassium hydroxide solution used here is designated B (mL). For the above-described sample solution that has been stirred for 10 hours, the magnetic body is magnetically separated and the soluble matter (the test solution from the magnetic toner or the resin) is titrated. The amount of potassium hydroxide solution used here is designated S (mL).

The acid value is calculated with the following formula. The f in this formula is a factor for the KOH. The W in this formula is mass of the sample.

$$\text{acid value (mg KOH/g)}=\{(S-B)\times f\times 5.61\}/W$$

EXAMPLES

The present invention is described in additional detail through the examples and comparative examples provided below, but the present invention is in no way restricted to these. The % and number of parts in the examples and comparative examples, unless specifically indicated otherwise, are in all instances on a mass basis.

<Binder Resin Production Examples>

(Binder Resin Production Example 1)

The molar ratio for the polyester monomers are as follows.

BPA-PO/BPA-EO/TPA/TMA=50/50/70/12

Here, BPA-PO refers to the 2.2 mole adduct of propylene oxide on bisphenol A; BPA-EO refers to the 2.2 mole adduct of ethylene oxide on bisphenol A; TPA refers to terephthalic acid; and TMA refers to trimellitic anhydride.

Of the starting monomers shown above, the starting monomers other than the TMA and 0.1 mass % tetrabutyl titanate as catalyst were introduced into a flask equipped with a water removal tube, stirring blade, nitrogen inlet tube, and so forth. After carrying out a condensation polymerization for 10 hours at 220° C., the TMA was further added and a reaction was carried out at 210° C. until the desired acid value was reached to yield a polyester resin 1 (glass-transition temperature Tg=64° C., acid value=17 mg KOH/g, and peak molecular weight=6200).

(Binder Resin Production Examples 2 to 5 and 7)

The peak molecular weight, glass-transition temperature Tg, and acid value were appropriately adjusted by changing the starting monomer ratio of Binder Resin Production Example 1 to obtain the binder resins 2 to 5 and 7 shown in Table 1.

(Binder Resin Production Example 6)

300 mass parts of xylene was introduced into a four-neck flask and was heated under reflux and a mixture of 80 mass parts of styrene, 20 mass parts of n-butyl acrylate, and 2.0 mass parts of di-tert-butyl peroxide was added dropwise over 5 hours to obtain a low molecular weight polymer (L-1) solution.

180 mass parts of degassed water and 20 mass parts of a 2 mass % aqueous polyvinyl alcohol solution were introduced into a four-neck flask; a liquid mixture of 78 mass parts of styrene, 22 mass parts of n-butyl acrylate, 0.005 mass parts of divinylbenzene, and 0.09 mass parts of 2,2-bis(4,4-di-tert-butylperoxycyclohexyl)propane (10-hour half-life temperature: 92° C.) was thereafter added; and stirring was carried out to yield a suspension. After the interior of the flask had been thoroughly replaced with nitrogen, the temperature was raised to 90° C. and polymerization was carried out; after holding for 24 hours, 0.1 mass parts of benzoyl peroxide (10-hour half-life temperature: 72° C.) was added and holding was continued for another 12 hours to finish the polymerization of a high molecular weight polymer (H-1).

25 mass parts of the high molecular weight polymer (H-1) was introduced into 300 mass parts of the low molecular weight polymer (L-1) solution and thorough mixing was carried out under reflux. This was followed by the distillative removal of the organic solvent to yield a binder resin 6 (glass-transition temperature Tg=61° C., acid value=0 mg KOH/g, peak molecular weight=11000), which was shown in the Table 1.

<Magnetic Toner Particle Production Example 1>

| | |
|---|---|
| binder resin 1 shown in Table 1 (peak molecular weight: 6200, Tg: 64° C., acid value: 17 mg KOH/g) | 100 mass parts |
| release agent 1 shown in Table 2 (behenyl behenate, melting point: 73° C.) | 5 mass parts |
| magnetic body 1 shown in Table 3 (composition: $Fe_3O_4$, shape: spherical, primary particle number-average particle diameter: 0.22 μm, magnetic characteristics for 79.6 kA/m: σs = 68 $Am^2/kg$ and σr = 3.5 $Am^2/kg$) | 80 mass parts |
| charge control agent (monoazo/iron compound T-77 (Hodogaya Chemical Co., Ltd.)) | 1 mass part |

The raw materials listed above were preliminarily mixed using an FM10C HENSCHEL™ MIXER (Mitsui Miike Chemical Engineering Machinery Co., Ltd.) and were then kneaded with a twin-screw kneader/extruder (PCM-30, Ikegai Ironworks Corporation) set at a rotation rate of 200 rpm with the set temperature being adjusted to provide a direct temperature in the vicinity of the outlet for the kneaded material of 140° C.

The resulting melt-kneaded material was cooled; the cooled melt-kneaded material was coarsely pulverized with a cutter mill; the resulting coarsely pulverized material was finely pulverized using a Turbo Mill T-250 (Turbo Kogyo Co., Ltd.); and classification was performed using a Coanda effect-based multifraction classifier to obtain a magnetic toner particle 1 having a weight-average particle diameter (D4) of 8.1 μm. The production conditions for magnetic toner particle 1 are shown in Table 2.

<Magnetic Toner Particle Production Examples 2 to 23>

Magnetic toner particles 2 to 23 were obtained proceeding as in Magnetic Toner Particle Production Example 1, with the exception that the type and content of the binder resin, release agent, and magnetic body in Magnetic Toner Particle Production Example 1 were changed as shown in Tables 1 to 4. Here, the peak molecular weight of the release agent 12 used in Magnetic Toner Particle Production Example 22 was 520. The production conditions for magnetic toner particles 2 to 23 are shown in Table 4.

<Magnetic Toner Particle Production Example 24>

External addition prior to a hot wind treatment was performed by mixing 100 mass parts (500 g) of magnetic toner particles 1 using an FM10C HENSCHEL™ MIXER (Mitsui Miike Chemical Engineering Machinery Co., Ltd.) with 0.50 mass parts (2.5 g) of the silica fine particles 1 used in the external addition and mixing process of Magnetic Toner Production Example 1, infra. The external addition conditions here were a rotation rate of 3000 rpm and a processing time of 2 minutes.

Then, after being subjected to this external addition prior to a hot wind treatment, the magnetic toner particles were subjected to surface modification using a Meteorainbow (Nippon Pneumatic Mfg. Co., Ltd.), which is a device that carries out the surface modification of toner particles using a hot wind blast. The surface modification conditions were a raw material feed rate of 2 kg/hr, a hot wind flow rate of 700 L/min, and a hot wind ejection temperature of 280° C. Magnetic toner particle 24 was obtained by carrying out this hot wind treatment. The production conditions for magnetic toner particle 24 are shown in Table 4.

<Magnetic Toner Particle Production Example 25>

Magnetic toner particle 25 was obtained proceeding as in Magnetic Toner Particle Production Example 1, with the exception that the type and content of the binder resin, release agent, and magnetic body in Magnetic Toner Particle Production Example 1 were changed as shown in Tables 1 to 4. The production conditions for magnetic toner particle 25 are shown in Table 4.

<Magnetic Toner Particle Production Example 26>

(Production of Sulfonic Acid Group-Containing Polymer A)

| | |
|---|---|
| methanol | 300 g |
| toluene | 100 g |
| styrene | 470 g |
| 2-ethylhexyl acrylate | 78 g |
| 2-acrylamido-2-methylpropanesulfonic acid | 42 g |
| lauroyl peroxide | 6 g |

The raw materials listed above were introduced into a flask; a stirrer, temperature measurement device, and nitrogen introduction device were installed; solution polymerization was carried out at 70° C. under a nitrogen atmosphere; and the polymerization reaction was completed by holding for 10 hours. The obtained polymer product was dried under reduced pressure and coarsely pulverized to obtain a polymer A that had a weight-average molecular weight (Mw) of 31500, a glass-transition temperature (Tg) of 71.8° C., an acid value of 15.0 mg KOH/g, and a number-average particle diameter of 410 μm.

(Production of Magnetic Toner Particle 26)

| | |
|---|---|
| binder resin 1 | 100 mass parts |
| release agent 13 (low molecular weight polyethylene, melting point: 102° C., number-average molecular weight Mn = 850) | 5 mass parts |
| magnetic body 1 | 80 mass parts |
| polymer A | 1 mass part |
| charge control agent (monoazo/iron compound T-77 (Hodogaya Chemical Co., Ltd.)) | 1 mass part |

Using the raw materials listed above, magnetic toner particle 26 was produced proceeding as in Magnetic Toner Particle Production Example 1. The production conditions for magnetic toner particle 26 are shown in Table 4.

TABLE 1

| | Type of resin | Peak molecular weight | Tg (° C.) | Acid value (mg KOH/g) |
|---|---|---|---|---|
| Binder resin 1 | Polyester resin | 6200 | 64 | 17 |
| Binder resin 2 | Polyester resin | 6600 | 65 | 5 |
| Binder resin 3 | Polyester resin | 6000 | 63 | 50 |
| Binder resin 4 | Polyester resin | 6700 | 66 | 2 |
| Binder resin 5 | Polyester resin | 5800 | 62 | 54 |
| Binder resin 6 | Styrene-acrylic resin | 11000 | 61 | 0 |
| Binder resin 7 | Polyester resin | 7750 | 58 | 5 |

TABLE 2

| | Type of release agent | Constituent fatty acid | Constituent alcohol | Melting point (° C.) | Number of carbons in the fatty acid | Number of ester functional groups |
|---|---|---|---|---|---|---|
| Release agent 1 | Monofunctional ester compound | Behenic acid | Behenyl alcohol | 73 | 22 | 1 |
| Release agent 2 | Monofunctional ester compound | Arachidic acid | Arachidic acid alcohol | 70 | 20 | 1 |
| Release agent 3 | Monofunctional ester compound | Stearic acid | Stearyl alcohol | 63 | 18 | 1 |
| Release agent 4 | Monofunctional ester compound | Behenic acid | Stearyl alcohol | 66 | 18 | 1 |
| Release agent 5 | Hexafunctional ester compound | Stearic acid | Dipentaerythritol | 77 | 18 | 6 |
| Release agent 6 | Hexafunctional ester compound | Palmitic acid | Dipentaerythritol | 69 | 16 | 6 |
| Release agent 7 | Hexafunctional ester compound | Behenic acid | Dipentaerythritol | 83 | 22 | 6 |
| Release agent 8 | Hexafunctional ester compound | Myristic acid | Dipentaerythritol | 60 | 14 | 6 |
| Release agent 9 | Hexafunctional ester compound | Lignoceric acid | Dipentaerythritol | 90 | 24 | 6 |
| Release agent 10 | Monofunctional ester compound | Palmitic acid | Behenyl alcohol | 53 | 16 | 1 |
| Release agent 11 | Hexafunctional ester compound | Hexacosanoic acid | Dipentaerythritol | 92 | 26 | 6 |
| Release agent 12 | Paraffin wax | — | — | 75 | — | — |
| Release agent 13 | Polyethylene | — | — | 102 | — | — |

TABLE 3

| | Particle diameter (μm) | σs ($Am^2/kg$) | σr ($Am^2/kg$) |
|---|---|---|---|
| Magnetic body 1 | 0.22 | 68 | 3.5 |
| Magnetic body 2 | 0.22 | 68 | 5.0 |
| Magnetic body 3 | 0.21 | 68 | 7.5 |
| Magnetic body 4 | 0.22 | 71 | 2.1 |
| Magnetic body 5 | 0.19 | 68 | 8.2 |
| Magnetic body 6 | 0.17 | 71 | 1.4 |

<Magnetic Toner Production Example 1>

An external addition and mixing process was carried out using the apparatus shown in FIG. 4 on the magnetic toner particle 1 provided by Magnetic Toner Particle Production Example 1.

In this example, the diameter of the inner circumference of the main casing 1 of the apparatus shown in FIG. 4 was 130 mm; the apparatus used had a volume for the processing space 9 of $2.0\times10^{-3}$ $m^3$; the rated power for the drive member 8 was 5.5 kW; and the stirring member 3 had the shape given in FIG. 5. The overlap width d in FIG. 5 between the stirring member 3*a* and the stirring member 3*b* was 0.25 D with respect to the maximum width D of the stirring member 3, and the clearance between the stirring member 3 and the inner circumference of the main casing 1 was 3.0 mm.

TABLE 4

| | Bnder resin | Magnetic body | Parts of addition of the magnetic body per 100 parts of the binder resin (mass parts) | Release agent | Parts of addition of the release agent per 100 parts of the binder resin (mass parts) | Weight-average particle diameter D4 (μm) |
|---|---|---|---|---|---|---|
| Magnetic toner particle 1 | Binder resin 1 | Magnetic body 1 | 80 | Release agent 1 | 5 | 8.1 |
| Magnetic toner particle 2 | Binder resin 1 | Magnetic body 1 | 80 | Release agent 2 | 5 | 8.2 |
| Magnetic toner particle 3 | Binder resin 1 | Magnetic body 1 | 80 | Release agent 3 | 5 | 8.1 |
| Magnetic toner particle 4 | Binder resin 1 | Magnetic body 1 | 80 | Release agent 4 | 5 | 8.0 |
| Magnetic toner particle 5 | Binder resin 1 | Magnetic body 1 | 80 | Release agent 5 | 5 | 8.2 |
| Magnetic toner particle 6 | Binder resin 2 | Magnetic body 1 | 80 | Release agent 5 | 5 | 8.1 |
| Magnetic toner particle 7 | Binder resin 3 | Magnetic body 1 | 80 | Release agent 5 | 5 | 8.3 |
| Magnetic toner particle 8 | Binder resin 4 | Magnetic body 1 | 80 | Release agent 5 | 5 | 8.1 |
| Magnetic toner particle 9 | Binder resin 5 | Magnetic body 1 | 80 | Release agent 5 | 5 | 8.2 |
| Magnetic toner particle 10 | Binder resin 5 | Magnetic body 2 | 52 | Release agent 5 | 5 | 8.1 |
| Magnetic toner particle 11 | Binder resin 5 | Magnetic body 3 | 52 | Release agent 5 | 5 | 8.1 |
| Magnetic toner particle 12 | Binder resin 5 | Magnetic body 4 | 155 | Release agent 5 | 5 | 8.3 |
| Magnetic toner particle 13 | Binder resin 5 | Magnetic body 5 | 47 | Release agent 5 | 5 | 8.1 |
| Magnetic toner particle 14 | Binder resin 5 | Magnetic body 5 | 52 | Release agent 5 | 5 | 8.2 |
| Magnetic toner particle 15 | Binder resin 5 | Magnetic body 6 | 160 | Release agent 5 | 5 | 8.1 |
| Magnetic toner particle 16 | Binder resin 5 | Magnetic body 6 | 52 | Release agent 6 | 5 | 8.0 |
| Magnetic toner particle 17 | Binder resin 5 | Magnetic body 6 | 52 | Release agent 7 | 5 | 8.4 |
| Magnetic toner particle 18 | Binder resin 5 | Magnetic body 6 | 52 | Release agent 8 | 5 | 8.2 |
| Magnetic toner particle 19 | Binder resin 5 | Magnetic body 6 | 52 | Release agent 9 | 5 | 8.1 |
| Magnetic toner particle 20 | Binder resin 5 | Magnetic body 6 | 52 | Release agent 10 | 5 | 8.1 |
| Magnetic toner particle 21 | Binder resin 5 | Magnetic body 6 | 52 | Release agent 11 | 5 | 8.1 |
| Magnetic toner particle 22 | Binder resin 5 | Magnetic body 6 | 52 | Release agent 12 | 5 | 8.2 |
| Magnetic toner particle 23 | Binder resin 6 | Magnetic body 6 | 52 | Release agent 8 | 5 | 8.2 |
| Magnetic toner particle 24 | Binder resin 1 | Magnetic body 1 | 80 | Release agent 1 | 5 | 8.1 |
| Magnetic toner particle 25 | Binder resin 7 | Magnetic body 1 | 80 | Release agent 12 | 5 | 6.1 |
| Magnetic toner particle 26 | Binder resin 1 | Magnetic body 1 | 80 | Release agent 13 | 5 | 6.8 |

100 mass parts of the magnetic toner particles 1 and 2.00 mass parts of the silica fine particles 1 described below were introduced into the apparatus shown in FIG. 4 having the apparatus structure described above.

Silica fine particles 1 were obtained by treating 100 mass parts of a silica with a BET specific surface area of 130 $m^2/g$ and a primary particle number-average particle diameter (D1) of 16 nm with 10 mass parts hexamethyldisilazane and then with 10 mass parts dimethylsilicone oil.

A pre-mixing was carried out after the introduction of the magnetic toner particles and the silica fine particles in order to uniformly mix the magnetic toner particles and the silica fine particles. The pre-mixing conditions were as follows: a drive member 8 power of 0.1 W/g (drive member 8 rotation rate of 150 rpm) and a processing time of 1 minute.

The external addition and mixing process was carried out once pre-mixing was finished. With regard to the conditions for the external addition and mixing process, the processing time was 5 minutes and the peripheral velocity of the outermost end of the stirring member 3 was adjusted to provide a constant drive member 8 power of 1.0 W/g (drive member 8 rotation rate of 1800 rpm). The conditions for the external addition and mixing process are shown in Table 5.

After the external addition and mixing process, the coarse particles and so forth were removed using a circular vibrating screen equipped with a screen having a diameter of 500 mm and an aperture of 75 μm to obtain magnetic toner 1. A value of 18 nm was obtained when magnetic toner 1 was submitted to magnification and observation with a scanning electron microscope and the number-average particle diameter of the primary particles of the silica fine particles on the magnetic toner surface was measured. The external addition conditions and properties of magnetic toner 1 are shown in Table 5 and Table 6, respectively.

<Magnetic Toner Production Example 2>

A magnetic toner 2 was obtained by following the same procedure as in Magnetic Toner Production Example 1, with the exception that silica fine particles 2 were used in place of the silica fine particles 1. Silica fine particles 2 were obtained by performing the same surface treatment as with silica fine particles 1, but on a silica that had a BET specific area of 200 $m^2/g$ and a primary particle number-average particle diameter (D1) of 12 nm. A value of 14 nm was obtained when magnetic toner 2 was submitted to magnification and observation with a scanning electron microscope and the number-average particle diameter of the primary particles of the silica fine particles on the magnetic toner surface was measured. The external addition conditions and properties of magnetic toner 2 are shown in Table 5 and Table 6.

<Magnetic Toner Production Example 3>

A magnetic toner 3 was obtained by following the same procedure as in Magnetic Toner Production Example 1, with the exception that silica fine particles 3 were used in place of the silica fine particles 1. Silica fine particles 3 were obtained by performing the same surface treatment as with silica fine particles 1, but on a silica that had a BET specific area of 90 $m^2/g$ and a primary particle number-average particle diameter (D1) of 25 nm. A value of 28 nm was obtained when magnetic toner 3 was submitted to magnification and observation with a scanning electron microscope and the number-average particle diameter of the primary particles of the silica fine particles on the magnetic toner surface was measured. The external addition conditions and properties of magnetic toner 3 are shown in Table 5 and Table 6.

<Magnetic Toner Production Examples 4 to 26, Magnetic Toner Production Examples 29 to 33 and Comparative Magnetic Toner Production Examples 1 to 27>

Magnetic toners 4 to 26, and 29 to 33 and comparative magnetic toners 1 to 27 were obtained using the magnetic toner particles shown in Table 4 in Magnetic Toner Production Example 1 in place of magnetic toner particle 1 and by performing respective external addition processing using the external addition recipes, external addition apparatuses, and external addition conditions shown in Table 5. The properties of magnetic toners 4 to 26, and 29 to 33 and comparative magnetic toners 1 to 27 are shown in Table 6.

Anatase titanium oxide fine particles (BET specific surface area: 80 $m^2/g$, primary particle number-average particle diameter (D1): 15 nm, treated with 12 mass % isobutyltrimethoxysilane) were used for the titania fine particles referenced in Table 5 and alumina fine particles (BET specific surface area: 80 $m^2/g$, primary particle number-average particle diameter (D1): 17 nm, treated with 10 mass % isobutyltrimethoxysilane) were used for the alumina fine particles referenced in Table 5.

Table 5 gives the proportion (mass %) of silica fine particles for the addition of titania fine particles and/or alumina fine particles in addition to silica fine particles.

For magnetic toners 29 to 33 and comparative magnetic toners 3 to 10, pre-mixing was not performed and the external addition and mixing process was carried out immediately after introduction.

The hybridizer referenced in Table 5 is the Hybridizer Model 5 (Nara Machinery Co., Ltd.), and the HENSCHEL™ MIXER referenced in Table 5 is the FM10C (Mitsui Miike Chemical Engineering Machinery Co., Ltd.).

<Magnetic Toner Production Example 27>

The external addition and mixing process was performed according to the following procedure using the same apparatus in FIG. 4 as in Magnetic Toner Production Example 1.

As shown in Table 5, the silica fine particle 1 (2.00 mass parts) added in Magnetic Toner Production Example 1 was changed to silica fine particle 1 (1.28 mass parts) and titania fine particles (0.22 mass parts).

First, 100 mass parts of magnetic toner particles 18, 0.40 mass parts of the silica fine particles, and 0.22 mass parts of the titania fine particles were introduced and the same pre-mixing as in Magnetic Toner Production Example 1 was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 1.0 W/g (drive member 8 rotation rate of 1800 rpm), after which the mixing process was temporarily stopped. The supplementary introduction of the remaining 0.88 mass part silica fine particles was then performed, followed by again processing for a processing time of 3 minutes while adjusting the peripheral velocity of the outermost end of the stirring member 3 so as to provide a constant drive member 8 power of 1.0 W/g (drive member 8 rotation rate of 1800 rpm), thus providing a total external addition and mixing process time of 5 minutes.

After the external addition and mixing process, the coarse particles and so forth were removed using a circular vibrating screen as in Magnetic Toner Production Example 1 to obtain magnetic toner 27. The external addition conditions for magnetic toner 27 are given in Table 5 and the properties of magnetic toner 27 are given in Table 6.

<Magnetic Toner Production Example 28>

The external addition and mixing process was performed according to the following procedure using the same apparatus in FIG. 4 as in Magnetic Toner Production Example 1.

As shown in Table 5, the silica fine particle 1 (2.00 mass parts) added in Magnetic Toner Production Example 1 was changed to silica fine particle 1 (1.28 mass parts) and titania fine particles (0.22 mass parts).

First, 100 mass parts of magnetic toner particles 18 and 1.28 mass parts of the silica fine particles were introduced and the same pre-mixing as in Magnetic Toner Production Example 1 was then performed.

In the external addition and mixing process carried out once pre-mixing was finished, processing was performed for a processing time of 2 minutes while adjusting the peripheral velocity of the outermost end of the stirring member 3 so as to provide a constant drive member 8 power of 1.0 W/g (drive member 8 rotation rate of 1800 rpm), after which the mixing process was temporarily stopped. The supplementary introduction of the remaining titania fine particles (0.22 mass parts with reference to 100 mass parts of magnetic toner particle 18) was then performed, followed by again processing for a processing time of 3 minutes while adjusting the peripheral velocity of the outermost end of the stirring member 3 so as to provide a constant drive member 8 power of 1.0 W/g (drive member 8 rotation rate of 1800 rpm), thus providing a total external addition and mixing process time of 5 minutes.

After the external addition and mixing process, the coarse particles and so forth were removed using a circular vibrating screen as in Magnetic Toner Production Example 1 to obtain magnetic toner 28. The external addition conditions for magnetic toner 28 are given in Table 5 and the properties of magnetic toner 28 are given in Table 6.

<Comparative Magnetic Toner Production Example 28>

An external addition process was carried out for 2 minutes at 4000 rpm using an FM10C HENSCHEL™ MIXER (Mitsui Miike Chemical Engineering Machinery Co., Ltd.) on 100 mass parts (500 g) of magnetic toner particles 1, 1.30 mass parts (6.5 g) of the silica fine particles 1 used in Magnetic Toner Production Example 1, and 0.60 mass parts of silica fine particles 4 (obtained by subjecting 100 mass parts of a silica having a BET specific surface area of 200 $m^2/g$ and a primary particle number-average particle diameter (D1) of 10 nm to surface treatment with 40 mass parts of a dimethylsiloxane and then subjecting 100 mass parts of the thusly treated silica to treatment with 10 mass parts of hexamethyldisilazane). The external addition conditions and properties of comparative magnetic toner 28 are shown in Tables 5 and 6, respectively.

<Comparative Magnetic Toner Production Example 29>

A comparative magnetic toner 29 was obtained by following the same procedure as in Magnetic Toner Production Example 1, with the exception that silica fine particles 5 were used in place of the silica fine particles 1. Silica fine particles 5 were obtained by performing the same surface treatment as with silica fine particles 1, but on a silica that had a BET specific area of 30 $m^2/g$ and a primary particle number-average particle diameter (D1) of 51 nm. A value of 53 nm was obtained when comparative magnetic toner 29 was submitted to magnification and observation with a scanning electron microscope and the number-average particle diameter of the primary particles of the silica fine particles on the magnetic toner surface was measured. The external addition conditions for magnetic toner 29 are shown in Table 5 and the properties of magnetic toner 29 are shown in Table 6.

TABLE 5

| Magnetic toner | Magnetic toner particle | Silica fine particles (mass parts) | Alumina fine particles (mass parts) | Titania fine particles (mass parts) | Content of silica fine particles (mass %) | Content of silica fine particles in the fixed inorganic line particles (mass %) | External addition apparatus | Operating conditions for the external additon apparatus | Operating time by the external additon apparatus |
|---|---|---|---|---|---|---|---|---|---|
| Magnetic toner 1 | Magnetic toner particle 1 | 2.00 | — | — | 100 | 100 | Apparatus of FIG. 4 | 1.0 W/g (1800 rpm) | 5 min |
| Magnetic toner 2 | Magnetic toner particle 1 | 2.00 | — | — | 100 | 100 | Apparatus of FIG. 4 | 1.0 W/g (1800 rpm) | 5 min |
| Magnetic toner 3 | Magnetic toner particle 1 | 2.00 | — | — | 100 | 100 | Apparatus of FIG. 4 | 1.0 W/g (1800 rpm) | 5 min |
| Magnetic toner 4 | Magnetic toner particle 2 | 2.00 | — | — | 100 | 100 | Apparatus of FIG. 4 | 1.0 W/g (1800 rpm) | 5 min |
| Magnetic toner 5 | Magnetic toner particle 3 | 2.00 | — | — | 100 | 100 | Apparatus of FIG. 4 | 1.0 W/g (1800 rpm) | 5 min |
| Magnetic toner 6 | Magnetic toner particle 4 | 2.00 | — | — | 100 | 100 | Apparatus of FIG. 4 | 1.0 W/g (1800 rpm) | 5 min |
| Magnetic toner 7 | Magnetic toner particle 5 | 2.00 | — | — | 100 | 100 | Apparatus of FIG. 4 | 1.0 W/g (1800 rpm) | 5 min |
| Magnetic toner 8 | Magnetic toner particle 6 | 2.00 | — | — | 100 | 100 | Apparatus of FIG. 4 | 1.0 W/g (1800 rpm) | 5 min |
| Magnetic toner 9 | Magnetic toner particle 7 | 2.00 | — | — | 100 | 100 | Apparatus of FIG. 4 | 1.0 W/g (1800 rpm) | 5 min |
| Magnetic toner 10 | Magnetic toner particle 8 | 2.00 | — | — | 100 | 100 | Apparatus of FIG. 4 | 1.0 W/g (1800 rpm) | 5 min |
| Magnetic toner 11 | Magnetic toner particle 9 | 2.00 | — | — | 100 | 100 | Apparatus of FIG. 4 | 1.0 W/g (1800 rpm) | 5 min |
| Magnetic toner 12 | Magnetic toner particle 10 | 2.00 | — | — | 100 | 100 | Apparatus of FIG. 4 | 1.0 W/g (1800 rpm) | 5 min |
| Magnetic toner 13 | Magnetic toner particle 11 | 2.00 | — | — | 100 | 100 | Apparatus of FIG. 4 | 1.0 W/g (1800 rpm) | 5 min |

TABLE 5-continued

| Magnetic toner | Magnetic toner particle | Silica fine particles (mass parts) | Alumina fine particles (mass parts) | Titania fine particles (mass parts) | Content of silica fine particles (mass %) | Content of silica fine particles in the fixed inorganic line particles (mass %) | External addition apparatus | Operating conditions for the external additon apparatus | Operating time by the external additon apparatus |
|---|---|---|---|---|---|---|---|---|---|
| Magnetic toner 14 | Magnetic toner particle 12 | 2.00 | — | — | 100 | 100 | Apparatus of FIG. 4 | 1.0 W/g (1800 rpm) | 5 min |
| Magnetic toner 15 | Magnetic toner particle 13 | 2.00 | — | — | 100 | 100 | Apparatus of FIG. 4 | 1.0 W/g (1800 rpm) | 5 min |
| Magnetic toner 16 | Magnetic toner particle 14 | 2.00 | — | — | 100 | 100 | Apparatus of FIG. 4 | 1.0 W/g (1800 rpm) | 5 min |
| Magnetic toner 17 | Magnetic toner particle 15 | 2.00 | — | — | 100 | 100 | Apparatus of FIG. 4 | 1.0 W/g (1800 rpm) | 5 min |
| Magnetic toner 18 | Magnetic toner particle 16 | 2.00 | — | — | 100 | 100 | Apparatus of FIG. 4 | 1.0 W/g (1800 rpm) | 5 min |
| Magnetic toner 19 | Magnetic toner particle 17 | 2.00 | — | — | 100 | 100 | Apparatus of FIG. 4 | 1.0 W/g (1800 rpm) | 5 min |
| Magnetic toner 20 | Magnetic toner particle 18 | 2.00 | — | — | 100 | 100 | Apparatus of FIG. 4 | 1.0 W/g (1800 rpm) | 5 min |
| Magnetic toner 21 | Magnetic toner particle 19 | 2.00 | — | — | 100 | 100 | Apparatus of FIG. 4 | 1.0 W/g (1800 rpm) | 5 min |
| Magnetic toner 22 | Magnetic toner particle 18 | 1.80 | — | — | 100 | 100 | Apparatus of FIG. 4 | 1.0 W/g (1800 rpm) | 5 min |
| Magnetic toner 23 | Magnetic toner particle 18 | 1.80 | — | — | 100 | 100 | Apparatus of FIG. 4 | 1.0 W/g (1800 rpm) | 5 min |
| Magnetic toner 24 | Magnetic toner particle 18 | 1.50 | — | — | 100 | 100 | Apparatus of FIG. 4 | 1.0 W/g (1800 rpm) | 5 min |
| Magnetic toner 25 | Magnetic toner particle 18 | 1.28 | 0.10 | 0.12 | 85 | 85 | Apparatus of FIG. 4 | 1.0 W/g (1800 rpm) | 5 min |
| Magnetic toner 26 | Magnetic toner particle 18 | 1.28 | — | 0.22 | 85 | 85 | Apparatus of FIG. 4 | 1.0 W/g (1800 rpm) | 5 min |
| Magnetic toner 27 | Magnetic toner particle 18 | 1.28 | — | 0.22 | 85 | 80 | Apparatus of FIG. 4 | 1.0 W/g (1800 rpm) | 5 min |
| Magnetic toner 28 | Magnetic toner particle 18 | 1.28 | — | 0.22 | 85 | 90 | Apparatus of FIG. 4 | 1.0 W/g (1800 rpm) | 5 min |
| Magnetic toner 29 | Magnetic toner particle 18 | 1.50 | — | — | 100 | 100 | Apparatus of FIG. 4 | No pre-mixing 0.6 W/g (1400 rpm) | 5 min |
| Magnetic toner 30 | Magnetic toner particle 19 | 1.50 | — | — | 100 | 100 | Apparatus of FIG. 4 | No pre-mixing 0.6 W/g (1400 rpm) | 5 min |
| Magnetic toner 31 | Magnetic toner particle 18 | 1.50 | — | — | 100 | 100 | Apparatus of FIG. 4 | No pre-mixing 0.6 W/g (1400 rpm) | 5 min |
| Magnetic toner 32 | Magnetic toner particle 18 | 2.60 | — | — | 100 | 100 | Apparatus of FIG. 4 | No pre-mixing 0.6 W/g (1400 rpm) | 5 min |
| Magnetic toner 33 | Magnetic toner particle 18 | 2.60 | — | — | 100 | 100 | Apparatus of FIG. 4 | No pre-mixing 16 W/g (2500 rpm) | 5 min |
| Comparative magnetic toner 1 | Magnetic toner particle 18 | 1.20 | 0.15 | 0.15 | 80 | 80 | Apparatus of FIG. 4 | 1.0 W/g (1800 rpm) | 5 min |
| Comparative magnetic toner 2 | Magnetic toner particle 18 | 1.20 | — | 0.30 | 80 | 80 | Apparatus of FIG. 4 | 1.0 W/g (1800 rpm) | 5 min |
| Comparative magnetic toner 3 | Magnetic toner particle 18 | 1.20 | — | — | 100 | 100 | Apparatus of FIG. 4 | No pre-mixing 0.6 W/g (1400 rpm) | 3 min |
| Comparative magnetic toner 4 | Magnetic toner particle 18 | 1.50 | — | — | 100 | 100 | Apparatus of FIG. 4 | No pre-mixing 0.5 W/g (1300 rpm) | 3 min |
| Comparative magnetic toner 5 | Magnetic toner particle 18 | 1.50 | — | — | 100 | 100 | Apparatus of FIG. 4 | No pre-mixing 1.6 W/g (2500 rpm) | 3 min |
| Comparative magnetic toner 6 | Magnetic toner particle 18 | 1.50 | — | — | 100 | 100 | Apparatus of FIG. 4 | No pre-mixing 2.2 W/g (3300 rpm) | 5 min |
| Comparative magnetic toner 7 | Magnetic toner particle 18 | 3.10 | — | — | 100 | 100 | Apparatus of FIG. 4 | No pre-mixing 1.6 W/g (2500 rpm) | 3 min |
| Comparative magnetic toner 8 | Magnetic toner particle 18 | 2.60 | — | — | 100 | 100 | Apparatus of FIG. 4 | No pre-mixing 0.6 W/g (1400 rpm) | 3 min |

TABLE 5-continued

| Magnetic toner | Magnetic toner particle | Silica fine particles (mass parts) | Alumina fine particles (mass parts) | Titania fine particles (mass parts) | Content of silica fine particles (mass %) | Content of silica fine particles in the fixed inorganic line particles (mass %) | External addition apparatus | Operating conditions for the external additon apparatus | Operating time by the external additon apparatus |
|---|---|---|---|---|---|---|---|---|---|
| Comparative magnetic toner 9 | Magnetic toner particle 18 | 3.10 | — | — | 100 | 100 | Apparatus of FIG. 4 | No pre-mixing 1.6 W/g (2500 rpm) | 3 min |
| Comparative magnetic toner 10 | Magnetic toner particle 18 | 2.60 | — | — | 100 | 100 | Apparatus of FIG. 4 | No pre-mixing 2.2 W/g (3300 rpm) | 3 min |
| Comparative magnetic toner 11 | Magnetic toner particle 18 | 1.50 | — | — | 100 | 100 | Hybridizer | 5500 rpm | 5 min |
| Comparative magnetic toner 12 | Magnetic toner particle 20 | 1.50 | — | — | 100 | 100 | Apparatus of FIG. 4 | 1.0 W/g (1800 rpm) | 5 min |
| Comparative magnetic toner 13 | Magnetic toner particle 21 | 1.50 | — | — | 100 | 100 | Apparatus of FIG. 4 | 1.0 W/g (1800 rpm) | 5 min |
| Comparative magnetic toner 14 | Magnetic toner particle 22 | 1.50 | — | — | 100 | 100 | Apparatus of FIG. 4 | 1.0 W/g (1800 rpm) | 5 min |
| Comparative magnetic toner 15 | Magnetic toner particle 23 | 1.50 | — | — | 100 | 100 | Apparatus of FIG. 4 | 1.0 W/g (1800 rpm) | 5 min |
| Comparative magnetic toner 16 | Magnetic toner particle 18 | 1.50 | — | — | 100 | 100 | Henschel mixer | 2700 rpm | 2 min |
| Comparative magnetic toner 17 | Magnetic toner particle 18 | 1.50 | — | — | 100 | 100 | Henschel mixer | 3600 rpm | 5 min |
| Comparative magnetic toner 18 | Magnetic toner particle 18 | 2.60 | — | — | 100 | 100 | Henschel mixer | 2700 rpm | 2 min |
| Comparative magnetic toner 19 | Magnetic toner particle 18 | 2.60 | — | — | 100 | 100 | Henschel mixer | 3600 rpm | 5 min |
| Comparative magnetic toner 20 | Magnetic toner particle 18 | 2.60 | — | — | 100 | 100 | Hybridizer | 5500 rpm | 5 min |
| Comparative magnetic toner 21 | Magnetic toner particle 18 | 2.60 | — | — | 100 | 100 | Hybridizer | 6500 rpm | 8 min |
| Comparative magnetic toner 22 | Magnetic toner particle 18 | 1.00 | — | — | 100 | 100 | Henschel mixer | 3600 rpm | 2 min |
| Comparative magnetic toner 23 | Magnetic toner particle 18 | 2.00 | — | — | 100 | 100 | Henschel mixer | 3600 rpm | 2 min |
| Comparative magnetic toner 24 | Magnetic toner particle 18 | 1.00 | — | — | 100 | 100 | Henschel mixer | 3600 rpm | 2 min |
| Comparative magnetic toner 25 | Magnetic toner particle 18 | 2.00 | — | — | 100 | 100 | Henschel mixer | 3600 rpm | 2 min |
| Comparative magnetic toner 26 | Magnetic toner particle 25 | 1.20 | — | — | 100 | 100 | Henschel mixer | 4000 rpm | 2 min |
| Comparative magnetic toner 27 | Magnetic toner particle 26 | 1.30 | — | — | 100 | 100 | Henschel mixer | 4000 rpm | 2 min |
| Comparative magnetic toner 28 | Magnetic toner particle 1 | Total 1.90 | — | — | 100 | 100 | Henschel mixer | 4000 rpm | 2 min |
| Comparative magnetic toner 29 | Magnetic toner particle 1 | 2.00 | — | — | 100 | 100 | Apparatus of FIG. 4 | 1.0 W/g (1800 rpm) | 5 min |

TABLE 6

| Magnetic toner | Magnetic toner particle | Coverage ratio A (%) | B/A (–) | Coefficient of variation on coverage ratio A (%) | Endo thermic peak of DSC (° c.) | $\sigma_s$ ($Am^2$/kg) | $\sigma_r/\sigma_s$ (–) | Magnetic body content (mass %) | Acid value (mg KOH/g) |
|---|---|---|---|---|---|---|---|---|---|
| Magnetic toner 1 | Magnetic toner particle 1 | 60.1 | 0.68 | 6.8 | 72 | 27 | 0.051 | 43 | 17 |
| Magnetic toner 2 | Magnetic toner particle 1 | 61.2 | 0.70 | 6.2 | 72 | 27 | 0.051 | 43 | 17 |
| Magnetic toner 3 | Magnetic toner particle 1 | 57.3 | 0.66 | 7.3 | 72 | 27 | 0.051 | 43 | 17 |
| Magnetic toner 4 | Magnetic toner particle 2 | 60.4 | 0.69 | 6.7 | 69 | 27 | 0.051 | 43 | 17 |
| Magnetic toner 5 | Magnetic toner particle 3 | 60.1 | 0.68 | 6.3 | 62 | 27 | 0.051 | 43 | 17 |
| Magnetic toner 6 | Magnetic toner particle 4 | 60.2 | 0.70 | 6.4 | 65 | 27 | 0.051 | 43 | 17 |
| Magnetic toner 7 | Magnetic toner particle 5 | 61.0 | 0.69 | 6.5 | 76 | 27 | 0.051 | 43 | 17 |
| Magnetic toner 8 | Magnetic toner particle 6 | 60.1 | 0.69 | 6.4 | 76 | 27 | 0.051 | 43 | 5 |
| Magnetic toner 9 | Magnetic toner particle 7 | 60.2 | 0.68 | 6.7 | 76 | 27 | 0.051 | 43 | 50 |
| Magnetic toner 10 | Magnetic toner particle 8 | 60.4 | 0.69 | 6.8 | 76 | 27 | 0.051 | 43 | 2 |
| Magnetic toner 11 | Magnetic toner particle 9 | 60.8 | 0.70 | 6.7 | 76 | 27 | 0.051 | 43 | 54 |
| Magnetic toner 12 | Magnetic toner particle 10 | 60.5 | 0.69 | 6.9 | 76 | 20 | 0.073 | 32 | 54 |
| Magnetic toner 13 | Magnetic toner particle 11 | 60.5 | 0.69 | 6.9 | 76 | 20 | 0.110 | 32 | 54 |

TABLE 6-continued

| Magnetic toner | Magnetic toner particle | Coverage ratio A (%) | B/A (–) | Coefficient of variation on coverage ratio A (%) | Endo thermic peak of DSC (° c.) | $\sigma_s$ ($Am^2$/kg) | $\sigma_r/\sigma_s$ (–) | Magnetic body content (mass %) | Acid value (mg KOH/g) |
|---|---|---|---|---|---|---|---|---|---|
| Magnetic toner 14 | Magnetic toner particle 12 | 60.1 | 0.68 | 6.4 | 76 | 45 | 0.030 | 59 | 54 |
| Magnetic toner 15 | Magnetic toner particle 13 | 60.1 | 0.67 | 6.5 | 76 | 18 | 0.120 | 29 | 54 |
| Magnetic toner 16 | Magnetic toner particle 14 | 60.4 | 0.69 | 6.7 | 76 | 20 | 0.120 | 32 | 54 |
| Magnetic toner 17 | Magnetic toner particle 15 | 60.4 | 0.69 | 6.8 | 76 | 45 | 0.020 | 62 | 54 |
| Magnetic toner 18 | Magnetic toner particle 16 | 60.4 | 0.68 | 6.6 | 68 | 18 | 0.120 | 29 | 54 |
| Magnetic toner 19 | Magnetic toner particle 17 | 60.2 | 0.70 | 6.6 | 83 | 18 | 0.120 | 33 | 54 |
| Magnetic toner 20 | Magnetic toner particle 18 | 60.1 | 0.70 | 6.8 | 60 | 18 | 0.120 | 33 | 54 |
| Magnetic toner 21 | Magnetic toner particle 19 | 60.1 | 0.68 | 6.7 | 90 | 18 | 0120 | 33 | 54 |
| Magnetic toner 22 | Magnetic toner particle 18 | 50.2 | 0.70 | 6.6 | 60 | 18 | 0.120 | 33 | 54 |
| Magnetic toner 23 | Magnetic toner particle 18 | 47.3 | 0.64 | 9.1 | 60 | 18 | 0.120 | 33 | 54 |
| Magnetic toner 24 | Magnetic toner particle 18 | 45.2 | 0.71 | 6.7 | 60 | 18 | 0.120 | 33 | 54 |
| Magnetic toner 25 | Magnetic toner particle 18 | 45.1 | 0.51 | 9.9 | 60 | 18 | 0.120 | 33 | 54 |
| Magnetic toner 26 | Magnetic toner particle 18 | 45.2 | 0.51 | 9.8 | 60 | 18 | 0.120 | 33 | 54 |
| Magnetic toner 27 | Magnetic toner particle 18 | 45.0 | 0.52 | 9.9 | 60 | 18 | 0.120 | 33 | 54 |
| Magnetic toner 28 | Magnetic toner particle 18 | 45.2 | 0.51 | 9.8 | 60 | 18 | 0.120 | 33 | 54 |
| Magnetic toner 29 | Magnetic toner particle 18 | 45.0 | 0.52 | 9.9 | 60 | 18 | 0.120 | 33 | 54 |
| Magnetic toner 30 | Magnetic toner particle 19 | 45.0 | 0.52 | 10.0 | 90 | 18 | 0.120 | 33 | 54 |
| Magnetic toner 31 | Magnetic toner particle 18 | 45.3 | 0.84 | 10.0 | 60 | 18 | 0.120 | 33 | 54 |
| Magnetic toner 32 | Magnetic toner particle 18 | 69.8 | 0.51 | 9.9 | 60 | 18 | 0.120 | 33 | 54 |
| Magnetic toner 33 | Magnetic toner particle 18 | 69.9 | 0.83 | 9.8 | 60 | 18 | 0.120 | 33 | 54 |
| Comparative magnetic toner 1 | Magnetic toner particle 18 | 45.1 | 0.51 | 9.8 | 60 | 18 | 0.120 | 33 | 54 |
| Comparative magnetic toner 2 | Magnetic toner particle 18 | 45.2 | 0.51 | 9.9 | 60 | 18 | 0120 | 33 | 54 |
| Comparative magnetic toner 3 | Magnetic toner particle 18 | 42.3 | 0.52 | 9.8 | 60 | 18 | 0.120 | 33 | 54 |
| Comparative magnetic toner 4 | Magnetic toner particle 18 | 45.3 | 0.48 | 9.9 | 60 | 18 | 0.120 | 33 | 54 |
| Comparative magnetic toner 5 | Magnetic toner particle 18 | 42.9 | 0.84 | 10.0 | 60 | 18 | 0.120 | 33 | 54 |
| Comparative magnetic toner 6 | Magnetic toner particle 18 | 45.1 | 0.89 | 10.0 | 60 | 18 | 0.120 | 33 | 54 |
| Comparative magnetic toner 7 | Magnetic toner particle 18 | 72.3 | 0.51 | 9.8 | 60 | 18 | 0.120 | 33 | 54 |
| Comparative magnetic toner 8 | Magnetic toner particle 18 | 69.7 | 0.46 | 9.9 | 60 | 18 | 0.120 | 33 | 54 |
| Comparative magnetic toner 9 | Magnetic toner particle 18 | 71.5 | 0.83 | 9.7 | 60 | 18 | 0.120 | 33 | 54 |
| Comparative magnetictoner 10 | Magnetic toner particle 18 | 69.9 | 0.87 | 99 | 60 | 18 | 0120 | 33 | 54 |
| Comparative magnetic toner 11 | Magnetic toner particle 18 | 45.0 | 0.52 | 12.1 | 60 | 18 | 0.120 | 33 | 54 |
| Comparative magnetic toner 12 | Magnetic toner particle 20 | 60.1 | 0.68 | 6.8 | 53 | 18 | 0.120 | 33 | 54 |
| Comparative magnetic toner 13 | Magnetic toner particle 21 | 60.1 | 0.67 | 6.7 | 92 | 18 | 0.120 | 33 | 54 |
| Comparative magnetic toner 14 | Magnetic toner particle 22 | 60.1 | 0.69 | 6.4 | 75 | 18 | 0.120 | 33 | 54 |
| Comparative magnetic toner 15 | Magnetic toner particle 23 | 60.4 | 0.67 | 6.5 | 60 | 18 | 0.120 | 33 | 54 |
| Comparative magnetic toner 16 | Magnetic toner particle 18 | 36.3 | 0.40 | 16.8 | 60 | 18 | 0.120 | 33 | 54 |
| Comparative magnetic toner 17 | Magnetic toner particle 18 | 39.8 | 0.43 | 16.2 | 60 | 18 | 0.120 | 33 | 54 |
| Comparative magnetic toner 18 | Magnetic toner particle 18 | 51.0 | 0.36 | 13.8 | 60 | 18 | 0.120 | 33 | 54 |
| Comparative magnetic toner 19 | Magnetic toner particle 18 | 51.9 | 0.37 | 13.1 | 60 | 18 | 0.120 | 33 | 54 |
| Comparative magnetic toner 20 | Magnetic toner particle 18 | 62.4 | 0.51 | 13.4 | 60 | 18 | 0.120 | 33 | 54 |
| Comparative magnetic toner 21 | Magnetic toner particle 18 | 65.3 | 0.85 | 13.1 | 60 | 18 | 0.120 | 33 | 54 |
| Comparative magnetic toner 22 | Magnetic toner particle 18 | 41.5 | 0.44 | 15.1 | 60 | 18 | 0.120 | 33 | 54 |
| Comparative magnetic toner 23 | Magnetic toner particle 18 | 55.2 | 0.44 | 15.1 | 60 | 18 | 0.120 | 33 | 54 |
| Comparative magnetic toner 24 | Magnetic toner particle 18 | 63.3 | 0.88 | 13.2 | 60 | 18 | 0.120 | 33 | 54 |
| Comparative magnetic toner 25 | Magnetic toner particle 18 | 72.0 | 0.83 | 13.1 | 60 | 18 | 0.120 | 33 | 54 |
| Comparative magnetic toner 26 | Magnetic toner particle 25 | 30.0 | 0.36 | 14.5 | 74 | 27 | 0.051 | 43 | 5 |
| Comparative magnetic toner 27 | Magnetic toner particle 26 | 33.1 | 0.38 | 14.0 | 98 | 27 | 0.051 | 43 | 17 |

TABLE 6-continued

| Magnetic toner | Magnetic toner particle | Coverage ratio A (%) | B/A (–) | Coefficient of variation on coverage ratio A (%) | Endo thermic peak of DSC (° c.) | $\sigma_s$ ($Am^2$/kg) | $\sigma_r/\sigma_s$ (–) | Magnetic body content (mass %) | Acid value (mg KOH/g) |
|---|---|---|---|---|---|---|---|---|---|
| Comparative magnetic toner 28 | Magnetic toner particle 1 | 47.1 | 0.39 | 13.4 | 72 | 27 | 0.051 | 43 | 17 |
| Comparative magnetic toner 29 | Magnetic toner particle 1 | 36.4 | 0.50 | 10.3 | 72 | 27 | 0.051 | 43 | 17 |

Example 1

The Image-Forming Apparatus

The image-forming apparatus was an LBP-3100 (Canon, Inc.), which was equipped with a small-diameter developing sleeve that had a diameter of 10 mm; its printing speed had been modified from 16 sheets/minute to 20 sheets/minute. This apparatus had also been modified so as to reduce the fixation temperature of the fixing unit by 35° C. FOX RIVER BOND paper (105 g/$m^2$) that had been held for 3 days in a high-temperature, high-humidity environment (32.5° C., 80% RH) was used as the recording medium. In an image-forming apparatus equipped with a small-diameter developing sleeve, the durability can be rigorously evaluated by changing the printing speed to 20 sheets/minute. In addition, the fixation tailing can be rigorously evaluated by using the aforementioned recording medium, which exhibits a large amount of moisture absorption and provides a poor transmission of the fixation temperature to the magnetic toner, and by changing the developing sleeve to a small-diameter developing sleeve, lowering the fixation temperature, and carrying out a continuous paper feed evaluation in a high-temperature, high-humidity environment.

(Durability Evaluation of Magnetic Toner 1)

Using the modified apparatus described above and magnetic toner 1, standing was carried out overnight in a high-temperature, high-humidity environment (32.5° C./80% RH) and a 3000-sheet image printing test was then performed in the same environment in one-sheet intermittent mode of horizontal lines at a print percentage of 1%.

(Evaluation of the Fixation Tailing for Magnetic Toner 1)

Using the modified apparatus described above and magnetic toner 1, standing was carried out overnight in the high-temperature, high-humidity environment and a 100-sheet image printing test was then performed in the same environment in continuous sheet feed mode of horizontal lines at a print percentage of 20%.

According to the results, a high density was obtained before and after the durability test and an image was obtained that presented little fogging in the nonimage areas. In addition, fixation tailing was also not produced in the fixation tailing evaluation. The results of the evaluations are shown in Table 7.

The evaluation methods and associated scales used in the evaluations carried out in the examples of the present invention and comparative examples are described below.

<Image Density>

For the image density, a solid image area was formed and the density of this solid image was measured with a MacBeth reflection densitometer (MacBeth Corporation). The following scale was used to evaluate the reflection density of the solid image at the start of the durability test (evaluation 1).

A: very good (greater than or equal to 1.45)
B: good (less than 1.45 and greater than or equal to 1.40)
C: average (less than 1.40 and greater than or equal to 1.35)
D: poor (less than 1.35)

The following scale was used to evaluate the image density after the latter half of the durability test (evaluation 2).

A difference between the reflection density of the solid image at the start of the durability test and the reflection density of the solid image after the 3000-sheet durability test was measured. A better result can be obtained as the difference becomes smaller.

A: very good (less than 0.05)
B: good (less than 0.10 and greater than or equal to 0.05)
C: average (less than 0.15 and greater than or equal to 0.10)
D: poor (greater than or equal to 0.15)

<Fogging>

A white image was output and its reflectance was measured using a REFLECTMETER MODEL TC-6DS from Tokyo Denshoku Co., Ltd. On the other hand, the reflectance was also similarly measured on the transfer paper (standard paper) prior to formation of the white image. A green filter was used as the filter. The fogging was calculated using the following formula from the reflectance before output of the white image and the reflectance after output of the white image.

fogging (reflectance) (%)=reflectance (%) of the standard paper−reflectance (%) of the white image sample The scale for evaluating the fogging (Evaluation 3) is below.

A: very good (less than 1.2%)
B: good (less than 2.0% and greater than or equal to 1.2%)
C: average (less than 3.0% and greater than or equal to 2.0%)
D: poor (greater than or equal to 3.0%)

<Fixation Tailing>

The frequency and degree of fixation tailing were visually evaluated during the continuous feed of 100 sheets. The scale used in this evaluation (evaluation 4) is given below.

A: fixation tailing is not produced
B: fixation tailing is produced on at least 1 sheet but not more than 5 sheets; degree also very light
C: fixation tailing is produced on at least 6 sheets but not more than 10 sheets; the level is unproblematic in practical terms because the degree is also light
D: fixation tailing is produced on at least 11 sheets but not more than 20 sheets
E: fixation tailing is produced on at least 21 sheets

Examples 2 to 33 and Comparative Examples 1 to 29

Toner evaluations were carried out under the same conditions as in Example 1 using magnetic toners 2 to 33 and comparative magnetic toners 1 to 29 for the magnetic toner. The results of the evaluations are shown in Table 7. With Comparative Examples 7 and 9, there was a very substantial amount of released silica fine particles on the developing sleeve and image defects in the form of vertical streaks were produced. When the magnetic toner particle 20 used in Comparative Example 12 was held overnight in the high-temperature, high-humidity environment, a large number of aggregates was produced by the magnetic toner and image defects in the form of vertical streaks were produced.

TABLE 7

| | | Evaluation 1 (starting density) | Evaluation 2 (extent of density decline) | Evaluation 3 (fogging) | Evaluation 4 (fixation tailing) |
|---|---|---|---|---|---|
| Example 1 | Magnetic toner 1 | A(1.48) | A(0.03) | A(0.5) | A |
| Example 2 | Magnetic toner 2 | A(1.46) | A(0.04) | A(0.7) | A |
| Example 3 | Magnetic toner 3 | A(1.42) | A(0.03) | A(0.6) | A |
| Example 4 | Magnetic toner 4 | A(1.46) | A(0.04) | A(0.7) | A |
| Example 5 | Magnetic toner 5 | A(1.47) | A(0.04) | A(0.6) | A |
| Example 6 | Magnetic toner 6 | A(1.47) | A(0.04) | A(0.7) | B |
| Example 7 | Magnetic toner 7 | A(1.46) | A(0.04) | A(0.6) | B |
| Example 8 | Magnetic toner 8 | A(1.45) | A(0.03) | A(0.7) | B |
| Example 9 | Magnetic toner 9 | A(1.46) | A(0.04) | A(0.5) | B |
| Example 10 | Magnetic toner 10 | A(1.45) | A(0.04) | A(0.4) | C |
| Example 11 | Magnetic toner 11 | B(1.44) | B(0.06) | A(0.7) | B |
| Example 12 | Magnetic toner 12 | B(1.43) | B(0.09) | A(0.5) | B |
| Example 13 | Magnetic toner 13 | B(1.40) | B(0.09) | A(0.5) | B |
| Example 14 | Magnetic toner 14 | B(1.41) | B(0.09) | A(0.8) | B |
| Example 15 | Magnetic toner 15 | C(1.38) | B(0.08) | B(1.5) | C |
| Example 16 | Magnetic toner 16 | B(1.41) | B(0.08) | A(0.8) | C |
| Example 17 | Magnetic toner 17 | B(1.41) | B(0.08) | B(1.7) | C |
| Example 18 | Magnetic toner 18 | C(1.37) | B(0.09) | B(1.6) | C |
| Example 19 | Magnetic toner 19 | C(1.36) | B(0.08) | B(1.5) | C |
| Example 20 | Magnetic toner 20 | C(1.37) | C(0.12) | B(1.3) | D |
| Example 21 | Magnetic toner 21 | C(1.38) | C(0.14) | B(1.7) | D |
| Example 22 | Magnetic toner 22 | C(1.39) | C(0.11) | B(1.3) | D |
| Example 23 | Magnetic toner 23 | C(1.39) | C(0.11) | B(1.3) | D |
| Example 24 | Magnetic toner 24 | C(1.37) | C(0.12) | B(1.3) | D |
| Example 25 | Magnetic toner 25 | C(1.37) | C(0.13) | B(1.6) | D |
| Example 26 | Magnetic toner 26 | C(1.37) | C(0.11) | B(1.5) | D |
| Example 27 | Magnetic toner 27 | B(1.44) | B(0.06) | B(1.6) | C |
| Example 28 | Magnetic toner 28 | B(1.40) | B(0.09) | B(1.5) | C |
| Example 29 | Magnetic toner 29 | C(1.38) | C(0.12) | B(1.4) | D |
| Example 30 | Magnetic toner 30 | C(1.36) | C(0.13) | B(1.6) | D |
| Example 31 | Magnetic toner 31 | C(1.37) | C(0.12) | B(1.5) | D |
| Example 32 | Magnetic toner 32 | C(1.35) | C(0.12) | B(1.6) | D |
| Example 33 | Magnetic toner 33 | C(1.37) | C(0.13) | B(1.5) | D |
| Comparative Example 1 | Comparative magnetic toner 1 | D(1.32) | C(0.14) | C(2.2) | E |
| Comparative Example 2 | Comparative magnetic toner 2 | C(1.37) | C(0.13) | C(2.1) | E |
| Comparative Example 3 | Comparative magnetic toner 3 | C(1.37) | C(0.12) | B(1.5) | E |
| Comparative Example 4 | Comparative magnetic toner 4 | C(1.35) | C(0.13) | B(1.6) | E |
| Comparative Example 5 | Comparative magnetic toner 5 | C(1.37) | D(0.16) | B(1.4) | E |
| Comparative Example 6 | Comparative magnetic toner 6 | C(1.37) | D(0.18) | B(1.6) | E |
| Comparative Example 7 | Comparative magnetic toner 7 | C(1.36) | C(0.12) | C(2.3) | E |
| Comparative Example 8 | Comparative magnetic toner 8 | C(1.37) | C(0.13) | C(2.1) | E |
| Comparative Example 9 | Comparative magnetic toner 9 | C(1.35) | D(0.19) | B(1.6) | E |
| Comparative Example 10 | Comparative magnetic toner 10 | C(1.37) | D(0.18) | B(1.4) | E |
| Comparative Example 11 | Comparative magnetic toner 11 | C(1.37) | C(0.13) | C(2.3) | E |
| Comparative Example 12 | Comparative magnetic toner 12 | D(1.12) | D(0.34) | A(0.7) | E |
| Comparative Example 13 | Comparative magnetic toner 13 | D(1.22) | D(0.19) | A(0.8) | E |
| Comparative Example 14 | Comparative magnetic toner 14 | B(1.41) | B(0.08) | A(0.6) | E |
| Comparative Example 15 | Comparative magnetic toner 15 | A(1.45) | A(0.03) | A(0.6) | E |
| Comparative Example 16 | Comparative magnetic toner 16 | B(1.41) | B(0.08) | B(1.3) | E |
| Comparative Example 17 | Comparative magnetic toner 17 | B(1.41) | B(0.08) | B(1.7) | E |
| Comparative Example 18 | Comparative magnetic toner 18 | B(1.42) | B(0.07) | B(1.6) | E |
| Comparative Example 19 | Comparative magnetic toner 19 | B(1.41) | B(0.08) | B(1.4) | E |
| Comparative Example 20 | Comparative magnetic toner 20 | B(1.42) | B(0.08) | B(1.6) | E |
| Comparative Example 21 | Comparative magnetic toner 21 | B(1.42) | B(0.07) | B(1.5) | E |
| Comparative Example 22 | Comparative magnetic toner 22 | B(1.41) | B(0.08) | B(1.6) | E |
| Comparative Example 23 | Comparative magnetic toner 23 | B(1.42) | B(0.07) | B(1.5) | E |
| Comparative Example 24 | Comparative magnetic toner 24 | B(1.43) | B(0.08) | B(1.6) | E |
| Comparative Example 25 | Comparative magnetic toner 25 | B(1.42) | B(0.07) | B(1.5) | E |
| Comparative Example 26 | Comparative magnetic toner 26 | B(1.43) | B(0.08) | B(1.6) | E |
| Comparative Example 27 | Comparative magnetic toner 27 | B(1.41) | B(0.08) | B(1.5) | E |
| Comparative Example 28 | Comparative magnetic toner 28 | B(1.42) | B(0.07) | B(1.3) | E |
| Comparative Example 29 | Comparative magnetic toner 29 | B(1.43) | A(0.04) | B(1.3) | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-285913, filed on Dec. 27, 2011, which is hereby incorporated by reference herein in its entirety.

REFERENCE SIGNS LIST

1: main casing
2: rotating member
3, 3*a*, 3*b*: stirring member
4: jacket
5: raw material inlet port
6: product discharge port
7: center shaft
8: drive member
9: processing space
10: end surface of the rotating member
11: direction of rotation
12: back direction
13: forward direction
16: raw material inlet port inner piece
17: product discharge port inner piece
d: distance showing the overlapping portion of the stirring members
D: stirring member width
100: electrostatic latent image-bearing member (photosensitive member)
102: toner-carrying member
103: developing blade
114: transfer member (transfer charging roller)
116: cleaner container
117: charging member (charging roller)
121: laser generator (latent image-forming means, photoexposure apparatus)
123: laser
124: pick-up roller
125: transport belt
126: fixing unit
140: developing device
141: stirring member

The invention claimed is:

1. A magnetic toner comprising magnetic toner particles containing a binder resin, a release agent, and a magnetic body, and inorganic fine particles present on the surface of the magnetic toner particles, wherein;

the inorganic fine particles present on the surface of the magnetic toner particles comprise metal oxide fine particles, the metal oxide fine particles containing silica fine particles, and optionally containing titania fine particles and alumina fine particles, and a content of the silica fine particles being at least 85 mass % with respect to a total mass of the silica fine particles, the titania fine particles and the alumina fine particles, wherein;

when a coverage ratio A (%) is a coverage ratio of the magnetic toner particles' surface by the inorganic fine particles and a coverage ratio B (%) is a coverage ratio of the magnetic toner particles' surface by the inorganic fine particles that are fixed to the magnetic toner particles' surface, the magnetic toner has;

i) a coverage ratio A of at least 45.0% and not more than 70.0%, and a coefficient of variation on the coverage ratio A of not more than 10.0%, and ii) a ratio [coverage ratio B/coverage ratio A] of the coverage ratio B to the coverage ratio A of at least 0.50 and not more than 0.85, wherein the binder resin comprises a polyester resin, the release agent comprises an ester compound, and an endothermic peak is present from at least 60° C. to not more than 90° C. when the magnetic toner is measured with a differential scanning calorimeter (DSC).

2. The magnetic toner according to claim 1, wherein the ester compound comprises an ester compound of a fatty acid having from at least 16 to not more than 22 carbon atoms or an aliphatic alcohol having from at least 16 to not more than 22 carbon atoms.

3. The magnetic toner according to claim 1, wherein, for a magnetic field of 79.6 kA/m, the magnetic toner has an intensity of magnetization ($\sigma s$) of from at least 15 $Am^2/kg$ to not more than 45 $Am^2/kg$ and a ratio [$\sigma r/\sigma s$] of a residual magnetization ($\sigma r$) to the intensity of magnetization ($\sigma s$) of from at least 0.03 to not more than 0.11.

4. The magnetic toner according to claim 1, wherein an acid value, measured using a potentiometric titration apparatus, of a soluble matter obtained by dissolving the magnetic toner in a mixed solvent of toluene and ethanol is from at least 5 mg KOH/g to not more than 50 mg KOH/g.

5. The magnetic toner according to claim 1, wherein the ester compound comprises a monofunctional ester compound.

* * * * *